US009706883B2

(12) United States Patent
Shakkour et al.

(10) Patent No.: US 9,706,883 B2
(45) Date of Patent: Jul. 18, 2017

(54) FLUID DISPENSING SYSTEM

(71) Applicant: MAC FAUCETS, LLC, Hawthorne, CA (US)

(72) Inventors: Fadi Shakkour, Hawthorne, CA (US); Kong Xiangcun, Zhong Shan (CN); Manuel Medina, South Gate, CA (US)

( * ) Notice: Subject to any disclaimer, the term of this patent is extended or adjusted under 35 U.S.C. 154(b) by 0 days.

(21) Appl. No.: 14/622,866

(22) Filed: Feb. 14, 2015

(65) Prior Publication Data

US 2015/0230668 A1 Aug. 20, 2015

Related U.S. Application Data

(60) Provisional application No. 61/940,449, filed on Feb. 16, 2014.

(51) Int. Cl.
*B67D 1/00* (2006.01)
*A47K 5/12* (2006.01)

(52) U.S. Cl.
CPC ..... *A47K 5/1217* (2013.01); *A47K 5/1215* (2013.01)

(58) Field of Classification Search
CPC ..... A47K 5/1217; A47K 5/1215; A47K 2005/1218
USPC ..... 222/52, 63, 173, 333
See application file for complete search history.

(56) References Cited

U.S. PATENT DOCUMENTS 5,299,713 A * 4/1994 Saitoh ..... A47K 5/1217 222/255
6,209,752 B1 4/2001 Mitchell et al.
8,668,118 B2 * 3/2014 Tsai ..... B67D 7/62 222/180
2008/0121660 A1 * 5/2008 Ophardt ..... A47K 5/16 222/190
2011/0215115 A1 * 9/2011 Proper ..... B67D 7/76 222/173
2012/0248149 A1 * 10/2012 Pelfrey ..... B67D 1/108 222/214
2014/0124540 A1 * 5/2014 Ciavarella ..... A47K 5/14 222/190
2014/0263427 A1 * 9/2014 Muderlak ..... B05B 11/3052 222/52

OTHER PUBLICATIONS sureFlo Automatic Top Fill Bulk Liquid Soap Dispenser; Bobrick; www.bobrick.comk; 2014.
Bobrick Technical Data; Aug. 12, 2013.
(Continued)

*Primary Examiner* — Lien Ngo
(74) *Attorney, Agent, or Firm* — Patent Law Agency, LLC; Peter Ganjian

(57) ABSTRACT

The present invention discloses a fluid dispensing system that includes modularized components such as a flow-out member from which fluid dispenses, fluid displacement mechanism, including electronics associated therewith and a reservoir for storage of fluid. The flow-out member, fluid displacement mechanism, and components constituting the fluid dispensing system including the reservoir may have one of a linear or nonlinear cooperative relationship in terms of connectivity and operation, and may be positioned in one of a close proximity or remote locations from one another. Flow out member is provided that may moved in more that one direction to refill reservoir.

26 Claims, 32 Drawing Sheets

(56) References Cited

OTHER PUBLICATIONS

Bobrick Sureflo Automatic Counter-Mounted Soap Dispenser Installation Instructions; Jul. 29, 2013.
Motor-Bee—Motor and Servo Control Board; www.pc-control-co.uk/motorbee_info.htm; 2008.
Chicago Electronics Distributors; Peristaltic Liquid Pump with Silicone Tubeing; 2014.
EZ Fill Top-Fill Multi-Feed Soap Dispensing System by American Specialities, Inc. (ASI); Publication date: 2014; www.americanspecialties.com;.

* cited by examiner

FLUID DISPENSING SYSTEM

CROSS-REFERENCE TO RELATED APPLICATIONS

This Application is Non-Provisional Application that claims the benefit of priority of the U.S. Provisional Utility Patent Application 61/940,449 with a filing date 16 Feb. 2014, the entire disclosures which is expressly incorporated by reference in its entirety herein. It should be noted that where a definition or use of a term in the incorporated patent application is inconsistent or contrary to the definition of that term provided herein, the definition of that term provided herein applies and the definition of that term in the incorporated patent application does not apply.

BACKGROUND OF THE INVENTION

Field of the Invention

One or more embodiments of the present invention relates to fluid dispensing system and, more particularly, to an automated fluid dispensing system.

Description of Related Art

Conventional automatic soap dispensers are well known and have been in use for a number of years. Regrettably, due in part to a very tight, closed-system, interdependent integration design between the various components that constitute the conventional automatic soap dispensers, most require the use of a specifically designed proprietary components and in particular, proprietary soap reservoirs (or containers). Accordingly, for example, a soap container or bottle from one manufacturer of automatic soap dispenser cannot be used with another brand or manufacturer of automatic soap dispenser (or produced and sold by a third party manufacturer).

Further, most conventional automatic soap dispensers use a pump mechanism to displace (or cause to move) soap by being in direct contact with the soap. In other words, the soap must go through within the actual internal components of the pump in order to be displaced. For example, if a gear type pump (or reciprocating pump) is used, the soap contacts with and is displaced by the actual internal gears of the gear pump. The requirement of direct contact of soap with the internal components of pumps mechanisms of conventional automatic soap dispensers in order to displace the soap is disadvantageous as such a direct contact reduces the life of the pump. Further, if the pump has not been in operation for some time, the soap inside the pump will most likely loose moisture, loosing its fluidity (or viscosity), dry-out, and become solid, stuck to internal components of the pump.

Furthermore, most conventional automatic soap dispensers require a vertical linear line of cooperative relationship and in a very close proximity in terms of operation and connectivity between the various components thereof that constitutes the conventional automatic soap dispensers. Therefore, in order to assembly, install, and use most conventional automatic soap dispensers, a minimal vertically linear clearance under a vanity is required to fit the various components inline and vertically in close proximity therein.

Accordingly, in light of the current state of the art and the drawbacks to current dispensers mentioned above, a need exists for a fluid dispensing system that would be modularized, that would be isolated from the fluid being displaced, and that would not require linear cooperative relationship or close proximity between the components in terms of operation and connectivity.

BRIEF SUMMARY OF THE INVENTION

A non-limiting, exemplary aspect of an embodiment of the present invention provides a fluid dispensing system, comprising:

modularized components including:

a flow-out member from which fluid is dispensed;

fluid displacement mechanism that displaces fluid; and a reservoir for fluid;

the modularized components have one of a linear or nonlinear cooperative relationship in terms of connectivity and operation, and are positioned in one of a close proximity or remote locations from one another.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

FIG. 2B illustrates a perspective back or rear-view of the same, but with a second member of the housing removed.

FIGS. 6C-1 and 6C-2 are a non-limiting, exemplary flowcharts for operation of a controller of a regulator for priming the fluid dispensing system without using bypass or flush switch in accordance with one or more embodiments of the present invention.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

One or more embodiments of the present invention provide a fluid dispensing system that is fully modularized, isolated from the fluid that the fluid dispensing system is displacing, and does not require linear cooperative relationship or close proximity between the components in terms of operation and connectivity. Further, one or more embodiments of the present invention provide a fluid dispensing system that may use a flow-out member comprised of a single piece, sturdy material (e.g., copper base, nickel base, stainless steel, plastics, etc.), and that uses insulated connectivity without the additional requirement of sealants.

Figure 1A:
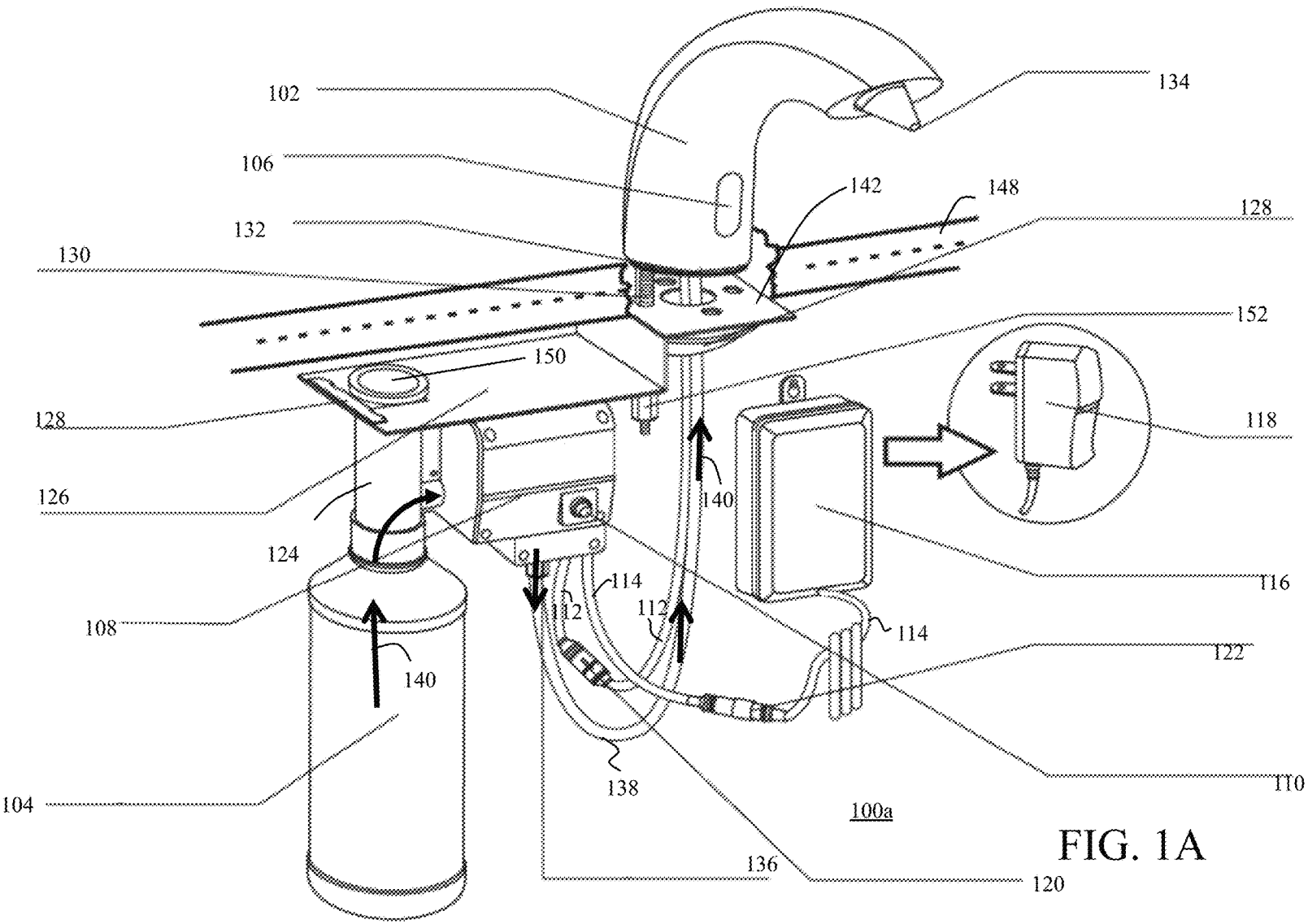
FIG. 1A is a non-limiting, exemplary, illustration of an overall systems overview of a fully assembled fluid dispensing system in accordance with one or more embodiments of the present invention.
Figure 1B:
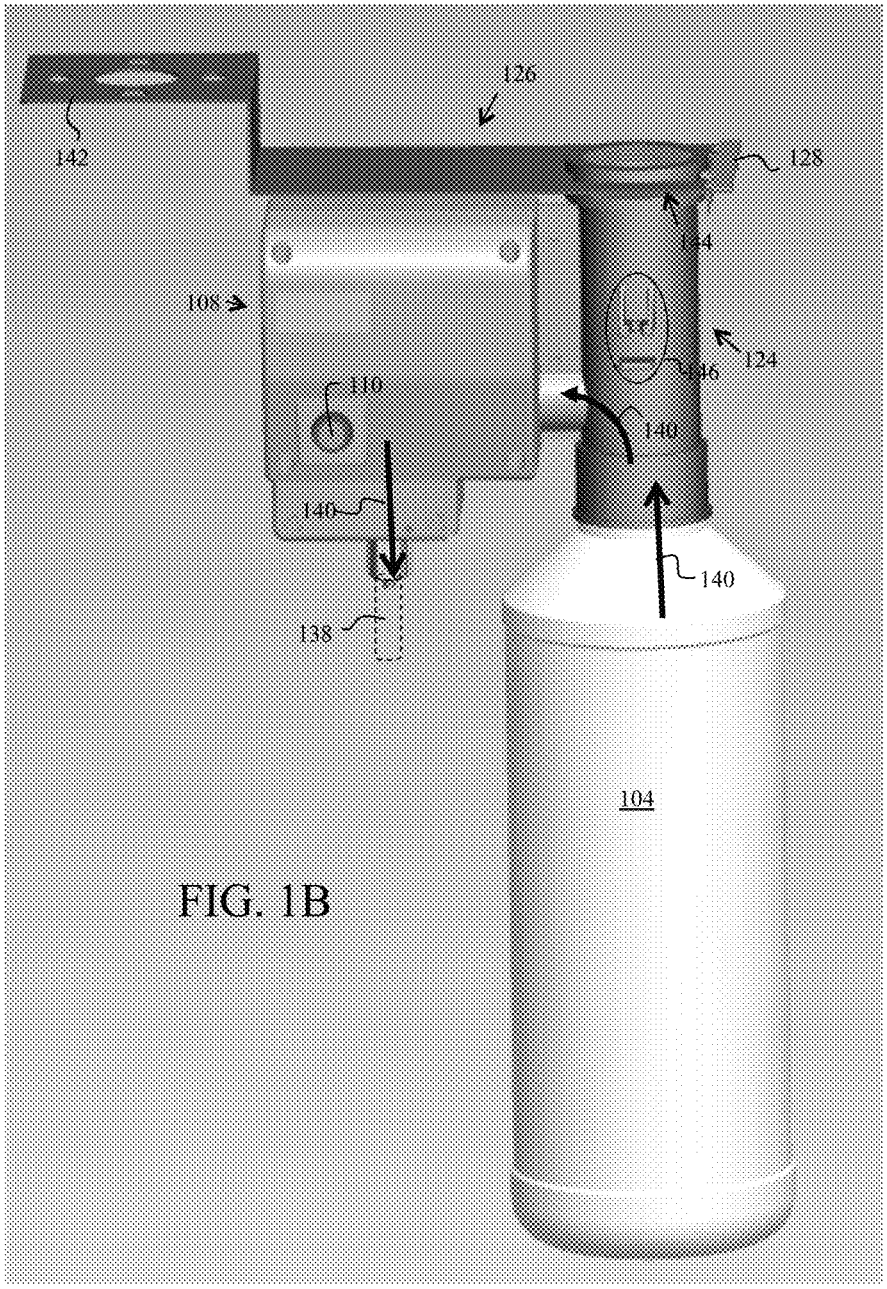
FIG. 1B is a non-limiting, exemplary over view illustration of fluid dispensing system without showing an outflow member in accordance with one or more embodiments of the present invention.

FIG. 1A is a non-limiting, exemplary, illustration of an overall systems overview of a fully assembled fluid dispensing system in accordance with one or more embodiments of the present invention, and FIG. 1B is a non-limiting, exemplary over view illustration of fluid dispensing system without showing an outflow member in accordance with one or more embodiments of the present invention. As illustrated in FIGS. 1A and 1B, one or more embodiments of the present invention provide a fluid dispensing system 100*a*, comprising a flow-out member 102 from which fluid is dispensed and a reservoir 104 for storage of fluid. Flow-out member 102 and reservoir 104 may have one of a linear or nonlinear cooperative relationship in terms of connectivity and operation, and may be positioned in one of a close proximity or remote locations from one another. Stated otherwise and as illustrated in FIGS. 1A and 1B, flow-out member 102 and reservoir 104 need not be linearly aligned or even positioned closed to one another. This provides space savings features and enables the use of a desired sized reservoir 104 (for example, much larger sized reservoir 104 may be used for even smaller compact cabinet space), particularly useful for commercial settings without requiring constant reordering of soap containers or soap refills from a specific manufacturer. As is apparent to those skilled in the art, space underneath sinks is very limited and hence, non-linear arrangement disclosed are beneficial. In general, fluid is displaced from fluid reservoir 104 (with the fluid flow shown by arrows 140) via a housing 108 that accommodates a fluid displacement mechanism 202 (FIG. 2A), through connected outer stage tubing 138 (shown in FIG. 1A) and to outflow member 102 via dedicate path.

As further illustrated, one or more embodiments of the present invention provide for a fluid dispensing system 100*a* that is comprised of flow-out member 102 with a nozzle 134 from which fluid is dispensed, with the nozzle 134 coupled with tube 138. Flow-out member 102 is preferably comprised of a single piece to thereby prevent potential accumulation of bacterial growth found in the junction of conventional multi-piece spouts.

Flow-out member 102 incorporates a regulator 106 that controls fluid displacement mechanism 202 (accommodated within housing 108) for controlled dispensing of fluid, wherein the fluid displaced, may follow a nonlinear path of a desired distance that spans from reservoir 104 to flow-out member 102. This means that fluid displacement mechanism 202 and or reservoir 104 may be remotely located from each other and or from flow-out member 102 at a desired distance, limited only by the displacement capability of fluid displacement mechanism 202 and length of illustrated tubes.

In general, regulator 106 is comprised of a well known detector (a generally well known Infrared (IR detector)) that senses an object within its detection (or surveillance) zone. Regulator 106 further includes a well known controller 602 (FIG. 6A) that is in communication with the detector for processing sensed signals from the detector for control of fluid displacement mechanism 202. Regulator 106 and its detector/controller are well known, conventional IR/controller unit that are extensively used in the automatic fluid dispensing systems. The detector, the controller, or both the detector and controller may be preferably positioned within flow-out member 102 to readily detect users hands.

In addition to accommodating fluid displacement mechanism 202, housing 108 also accommodate a bypass or flush switch 110 associated with fluid displacement mechanism 202, which enables bypassing of regulator control and functionality to flush out and bleed-out air or any fluid residue. Bypass or flush switch 110 may be positioned remotely from the rest of fluid displacement mechanism 202 and need not be accommodated within housing 108, limited in distance from fluid displacement mechanism 202 only by the length of electric wiring connection. As illustrated in FIGS. 1A and 1B, housing 108 is associated with reservoir 104 by an adapter-conduit 124 (further detailed below).

Electric power and data between regulator 106 and fluid displacement mechanism 202 is routed via wiring 112, and electric power for bypass or flush switch 110 and fluid displacement mechanism 202 is routed via wiring 114. All electric power for all electric or electronic components may be supplied by a set of batteries housed within a battery box 116 and or use of an AC power adaptor 118 that may be plugged into an AC outlet power source. It should be noted that preferably, all electrical wirings of fluid dispensing system 100*a* use insulated electrical wiring connectivity (e.g., the illustrated respective sensor or data/power connector plug 120 and power connector plug 122) to thereby avoid having to use additional sealants, which reduces installation time and costs. Battery box 116 and or optional AC power adaptor 118 may be positioned remotely, limited in distance only by the length of electric wiring connections. As best illustrated in FIG. 1B, adapter-conduit 124 may optionally include a holding structure 146 for rerouting and securing tubes or wiring, if needed.

As further illustrated in FIGS. 1A and 1B, reservoir 104, adapter-conduit 124, and housing 108 may be supported on a mounting support (e.g., suspension bracket) 126 that as detailed below may include a removable barrier 128 (e.g., a lock-key) to securely retain adapter-conduit 124 in place and hence, the associated reservoir 104. Fluid may be replenished by removing a simple cap 150 from top of adapter-conduit 124 or alternatively, reservoir 104 may be detached (unscrewed) from lower end of adapter-conduit 124 and directly refilled. As further detailed below, mounting support 126 itself is cantilevered by its connection to flow-out member 102 via washer 128 and shank fasteners 130 and nut 152, with a lower end of flow-out member 102 having an O-ring washer 132 that provides a seal connection with support member 126 as illustrated.

Figure 2A:
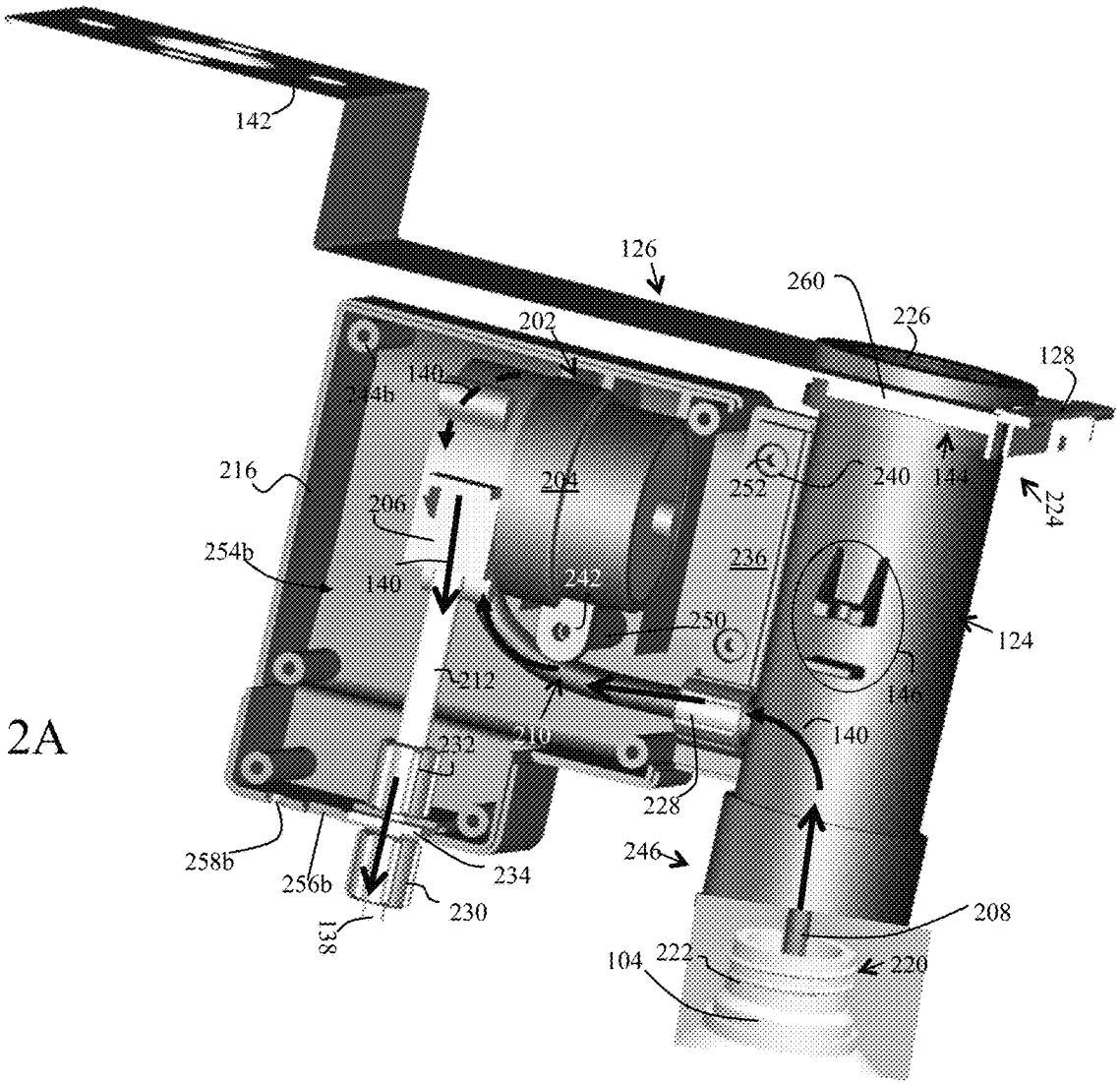
FIGS. 2A and 2B are non-limiting, exemplary partial views of fluid dispensing system in accordance with one or more embodiments of the present invention, with FIG. 2A illustrates a perspective front-view of parts of the fluid dispensing system with a first member of the housing removed.
Figure 2B:
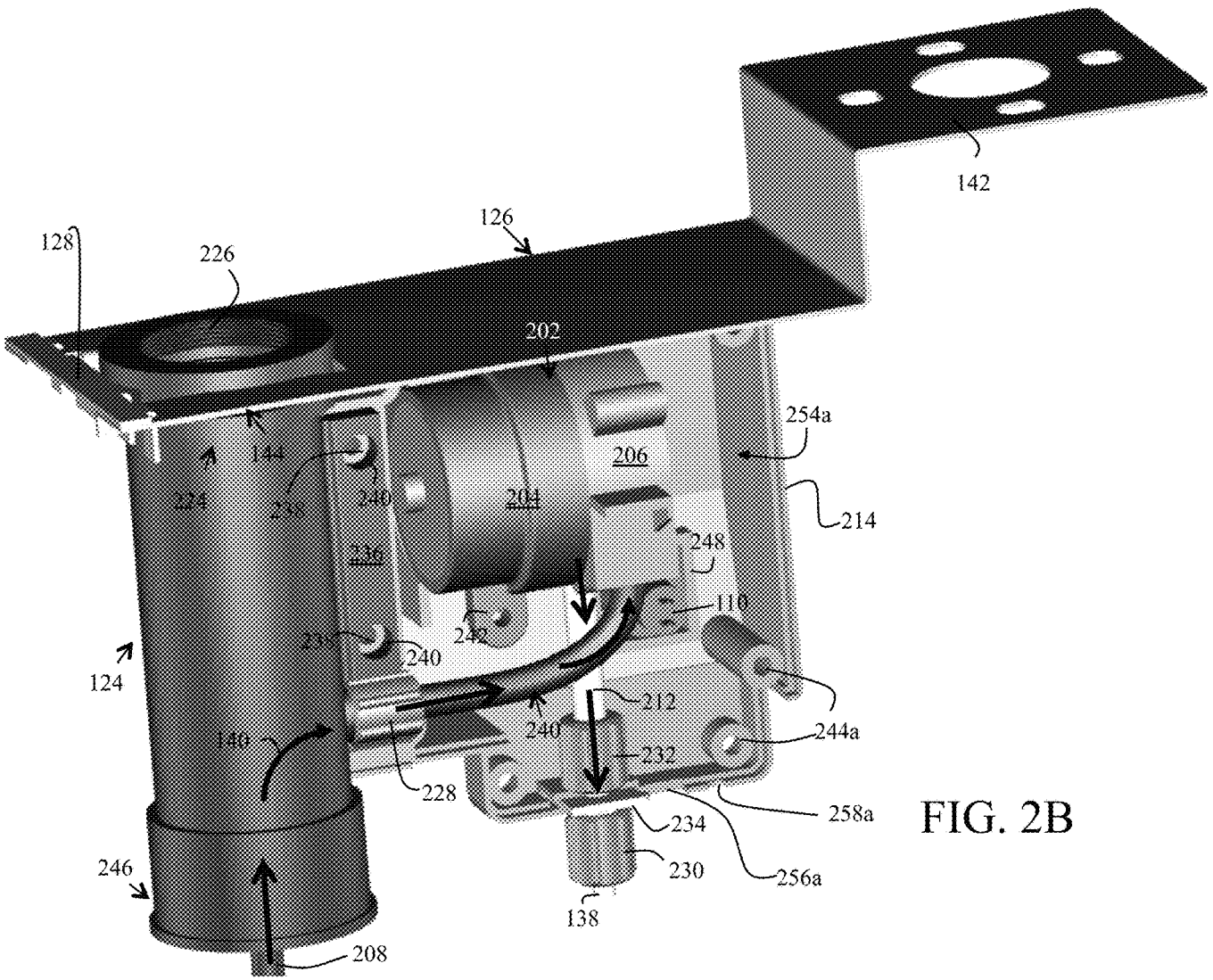

FIGS. 2A and 2B are non-limiting, exemplary partial views of fluid dispensing system in accordance with one or more embodiments of the present invention. FIG. 2A illustrates a perspective front-view of parts of fluid dispensing system with a first member 214 of housing 108 removed. FIG. 2B illustrates a perspective back or rear-view of the same, but with a second member 216 of housing 108 removed. As illustrated in FIGS. 2A and 2B and detailed below in relation to FIGS. 3A-1 to 3B-3, housing 108 is comprised of a first and second members 214 and 216. Housing 108 accommodates fluid displacement mechanism 202 and a flush switch 110, including wiring and circuitry (not shown in FIGS. 2A and 2B) for both, for powering fluid displacement mechanism 202. Flow of the fluid is in the direction indicated by arrows 140 and is displaced from reservoir 104 via tube 208 of adapter-conduit 124, a port structure 410 (best shown in FIGS. 4A, 4B, and 4C), tubing 210, and through fluid displacement mechanism 202, and out through outlet tubing 212 and into outer stage tubing 138 towards outflow member 102. It should be noted that although fluid displacement mechanism 202 is generally accommodated within housing 108, fluid displacement mechanism 202 may be remotely located outside housing 108 and away from the rest of the remaining components that constitute fluid dispensing system 100*a*.

Reservoir 104 couples with adapter-conduit 124, which, in turn, is coupled with first and second members 214 and 216 of housing 108. Reservoir 104 may be coupled with adapter-conduit 124 through a variety of mechanisms, non-limiting example of which may include a threaded coupling that use complementary male-female threading found in most "bottle-cap" type containers, with reservoir 104 having the male threading 222 and adapter-conduit 124 accommodating the female threading 404 (FIG. 4C). In fact, reservoir 104 in accordance with one or more embodiments of the present invention may comprise of any generic bottle that has any generic type of connection or securing mechanism (in this non-limiting, exemplary instance, the bottle has top end 220 that is threaded 222 (best shown in FIG. 2A) that is screwed onto the female threaded connection 404 (best shown in FIG. 4C) of the adapter-conduit 124. As further detailed below, adapter-conduit 124 functions as both an adapter to enable coupling of reservoir 104 with housing 108 and also a conduit to enable flow of fluid from reservoir 104 to flow-out member 102 and also possible flow of fluid from top of the adapter and into reservoir for refill.

FIGS. 3A-1 to 3B-3 are non-limiting, exemplary illustrations of various views of a first and second housing members in accordance with one or more embodiments of the present invention. As indicated above, housing 108 is comprised of first and second members 214 and 216 that coupled together to adapter-conduit 124, and accommodate fluid displacement mechanism 202 and flush switch 110, and wiring and circuitry for both, for powering fluid displacement mechanism 202.

Figures 1, 3A:
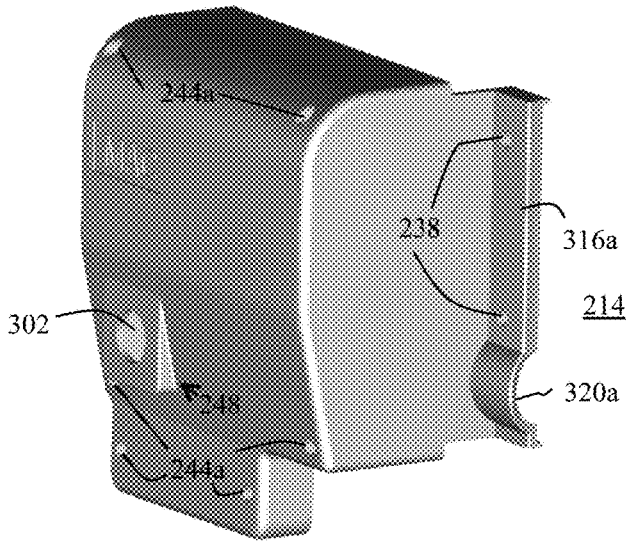
FIGS. 3A-1 to 3B-3 are non-limiting, exemplary illustrations of various views of first and second housing members in accordance with one or more embodiments of the present invention.
Figures 2, 3A:
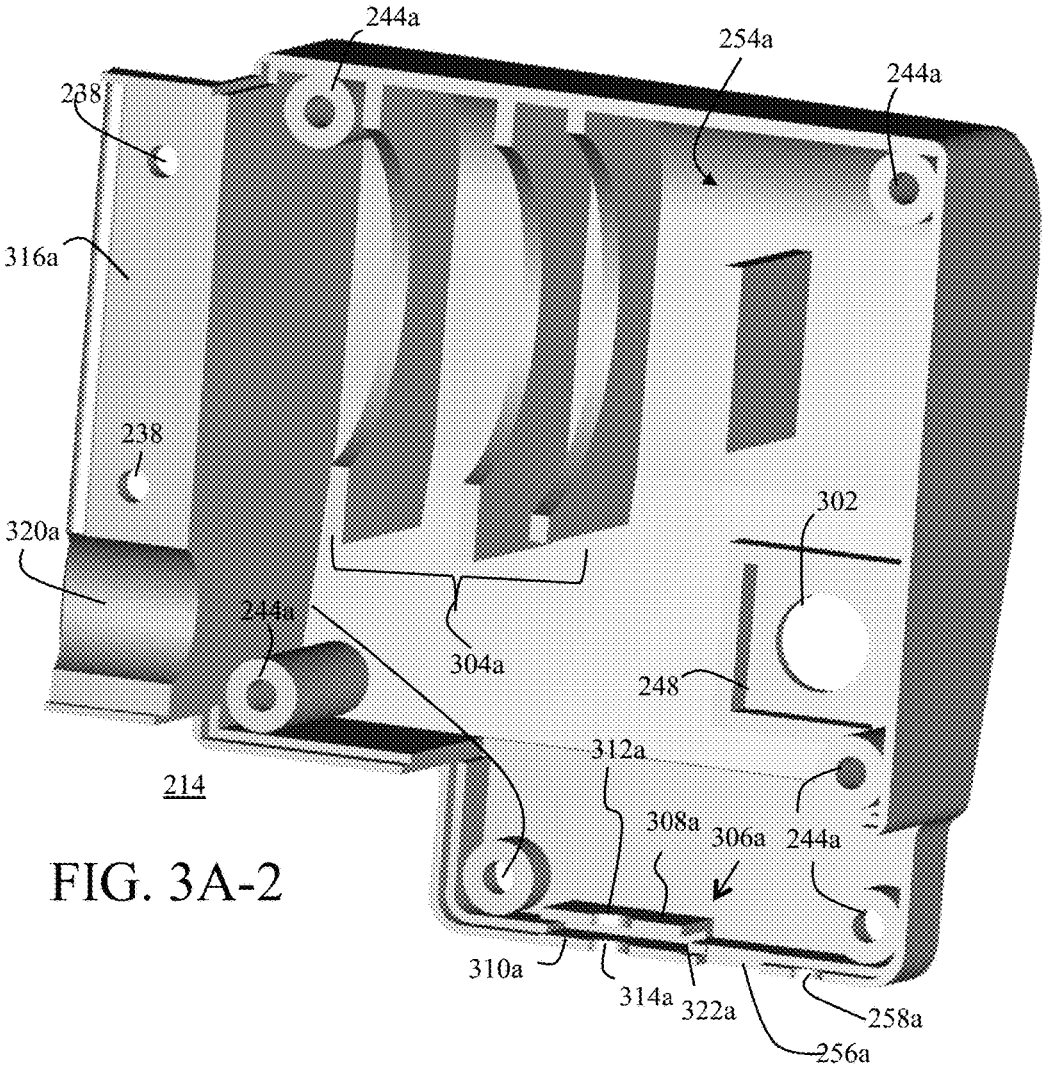
Figures 1, 3B:
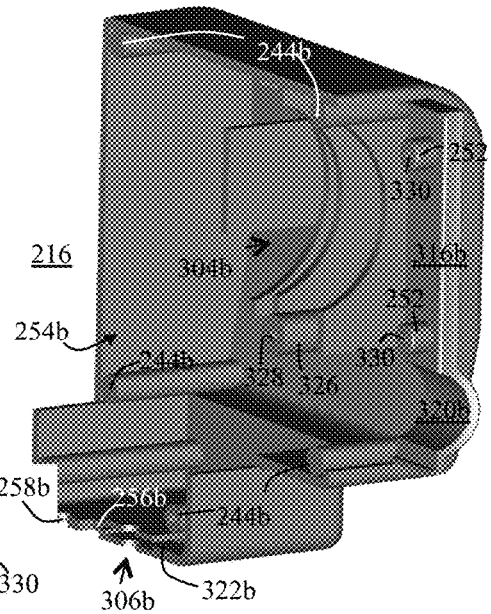
Figures 2, 3B:
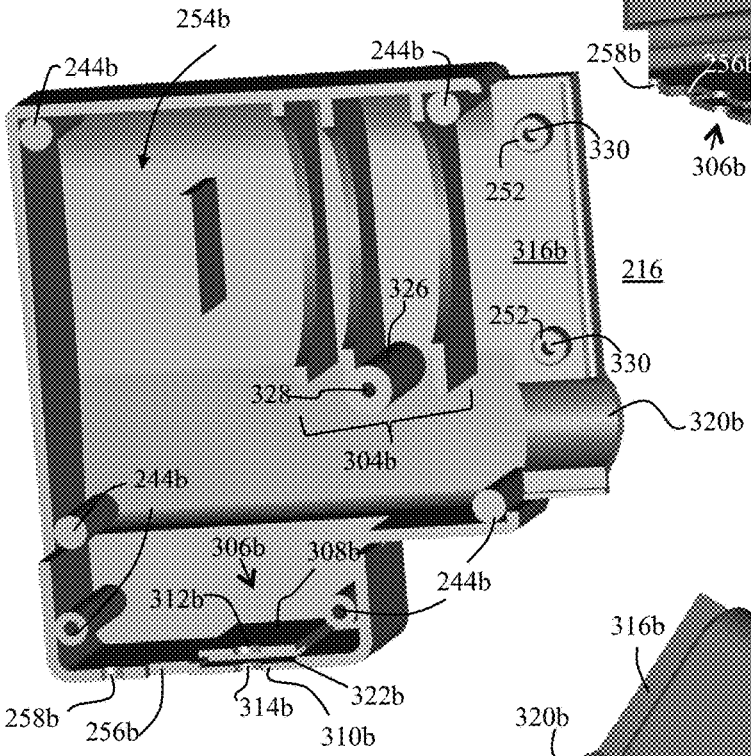

First member 214 (FIGS. 3A-1 to 3A-2) of housing 108 includes a set of coupling through-holes 244*a* that align with complementary set of coupling blind-holes 244*b* of second member 216 of housing 108 to receive fasteners to connect first and second members 214 and 216 to form housing 108. First member 214 includes a first cavity 254*a* with first set of restraining structures 304*a*, and second member 216 includes a second cavity 254*b* with a second set of restraining structures 304*b* that when positioned together, securely restrain fluid displacement mechanism 202 from movement. First cavity 254*a* of first member 214 further includes a compartment 248 with aperture 302 for accommodating access to flush switch 110. As illustrated in FIGS. 3B-1 and 3B-2, second cavity 254*b* of second member 216 further includes cylindrical protrusion 326 with a blind-hole 328 for fastening an anchoring flange 242 of fluid displacement mechanism 202 to second member 216 (as also shown in FIG. 2A).

First and second members 214 and 216 further include respective first connection portion 316*a* and second connection portion 316*b*, with first connection portion 316*a* comprised of a first set of apertures 238 and first semi-cylindrical end 320*a*, and second connection portion 316*b* comprised of corresponding set of cylindrical protrusions 252 with blind-holes 330, commensurate with first set of aperture 238, and a corresponding second semi-cylindrical end 320*b* commensurate with first semi-cylindrical end 320*a*.

First and second members 214 and 216 also include respective mounting structure 306*a/b* comprised of first and second flanges 308*a/b* and 310*a/b* that are spaced apart to form a channel 322*a/b* with respective aligned grooves 312*a/b* and 314*a/b*, which receive tube connection structures comprised of a connectivity fastener-plate 234 with a through-hole bolt that slides within and is secured in channel 322*a/b*, with tube 212 passed through the through-hole of fastener-plate 234, and secured between grooves 312*a/b* and 314*a/b* of first and second member 214 and 216 by a set of tubing nuts 232 and 234 (as shown in FIG. 2A). First and second members 214 and 216 further include power/data wiring access port 256*a/b* for wiring 112 and power wiring access port 258*a/b* for wiring 114.

Figure 4A:
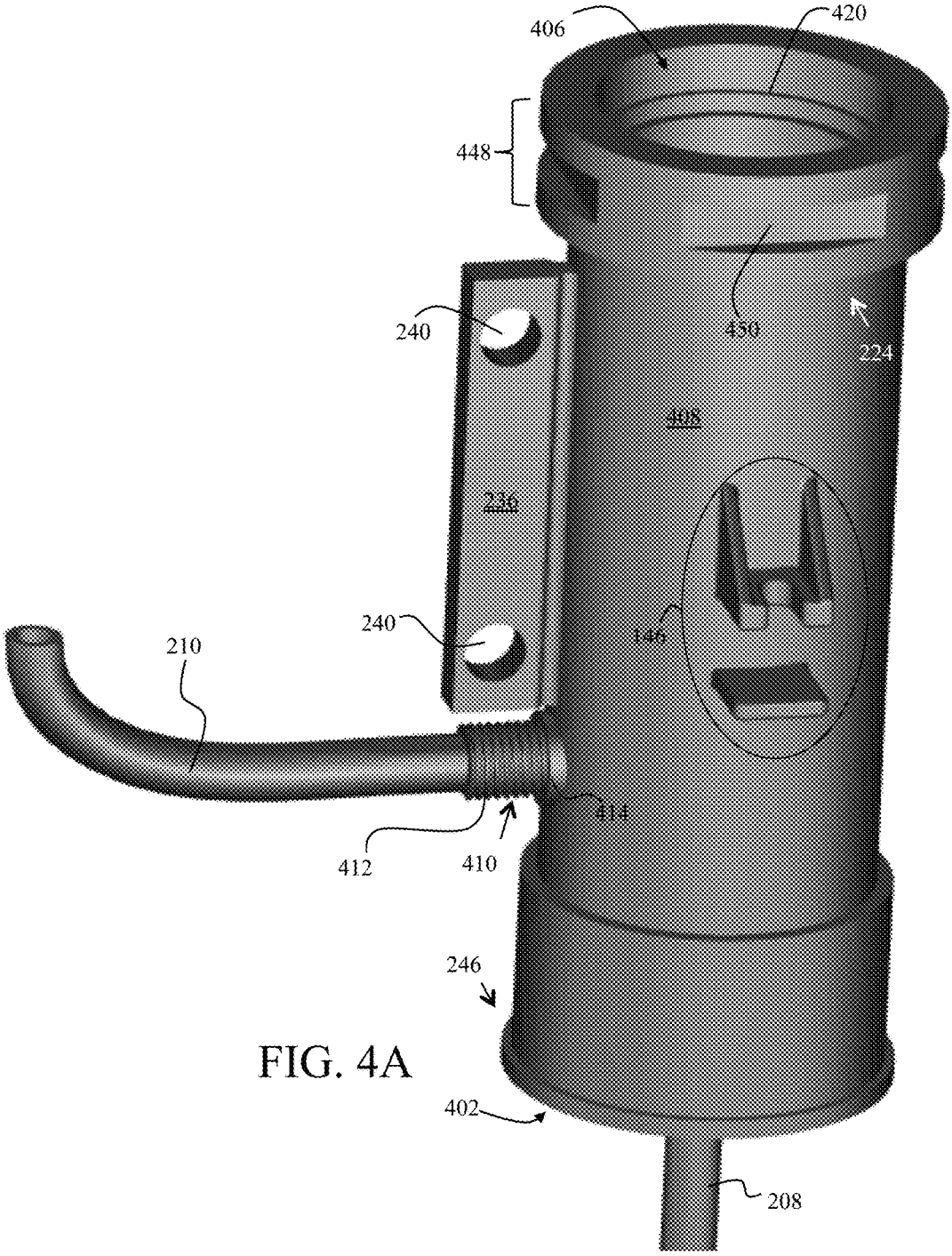
FIG. 4A is a non-limiting, exemplary illustration of an adapter-conduit in accordance with one or more embodiments of present invention.
Figure 4B:
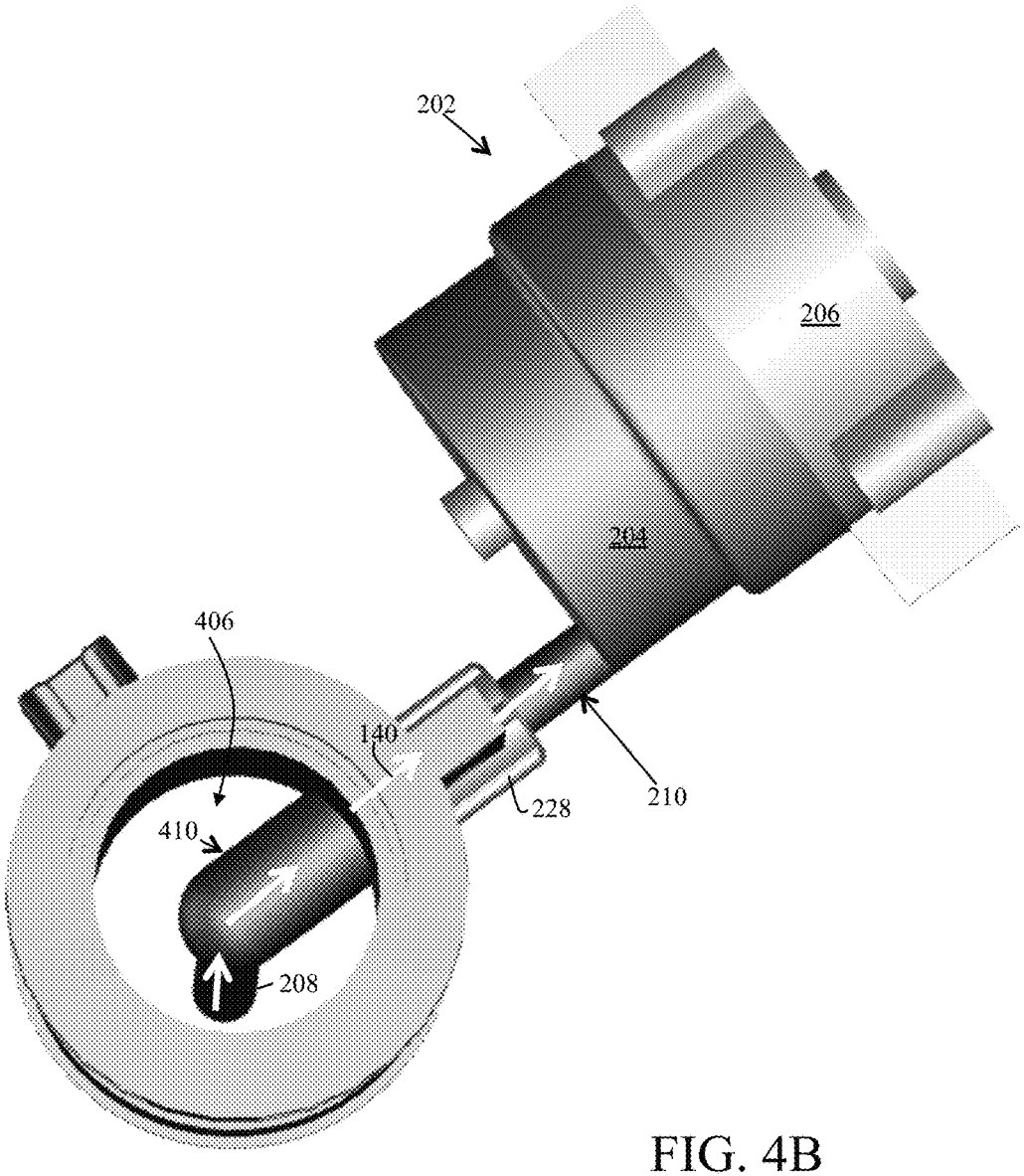
FIGS. 4B and 4C are non-limiting, exemplary illustration of various views of adapter-conduit and fluid displacement mechanism (without electrical wiring) in accordance with one or more embodiments of the present invention.
Figure 4C:
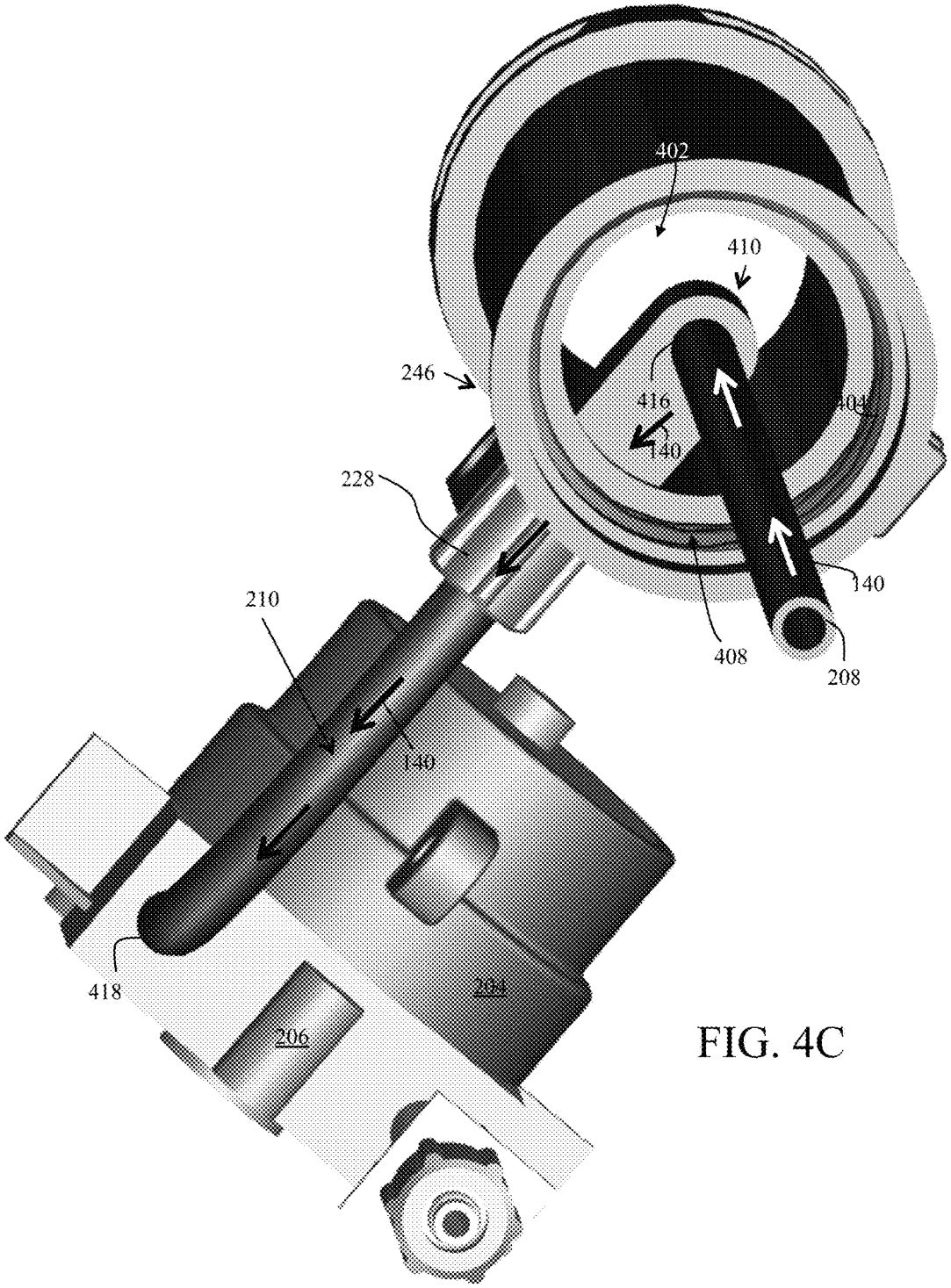
Figure 4D:
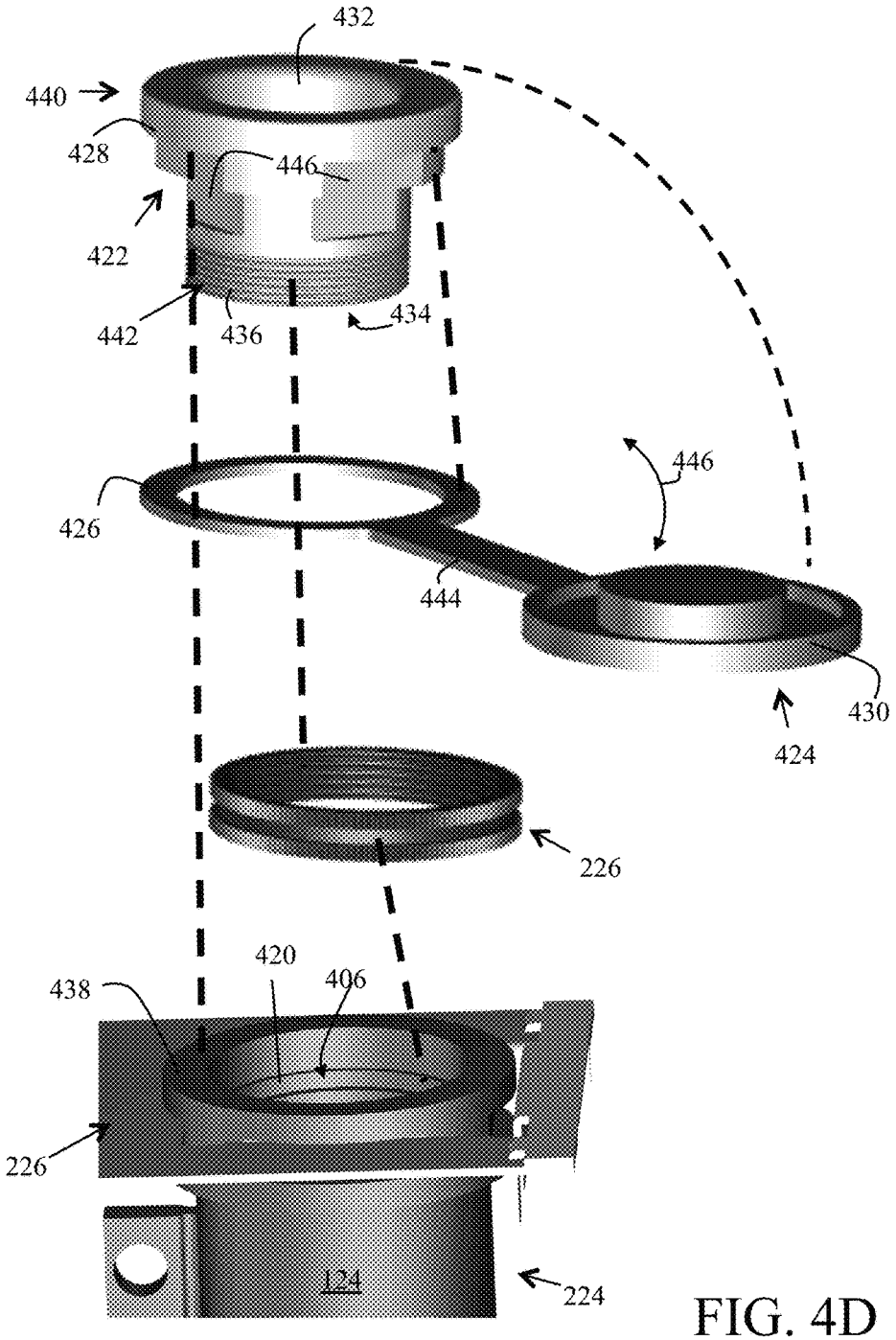
FIG. 4D is a non-limiting, exemplary illustration of optional components used for providing covering for adapter-conduit in accordance with one or more embodiments of the present invention.
Figure 5A:
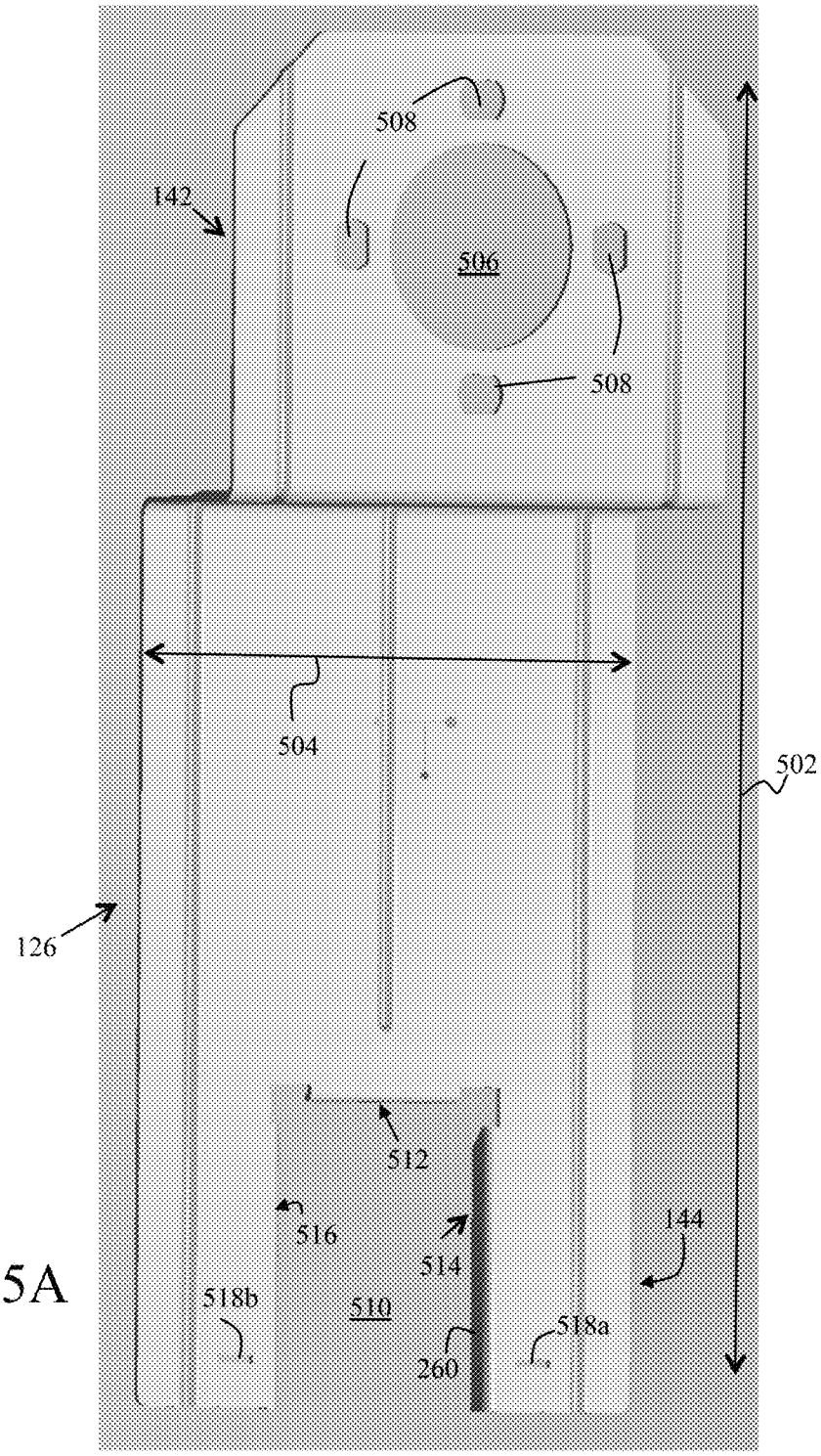
FIGS. 5A to 5D are non-limiting, exemplary illustrations of various views of a suspension bracket in accordance with one or more embodiments of the present invention.
Figure 5B:
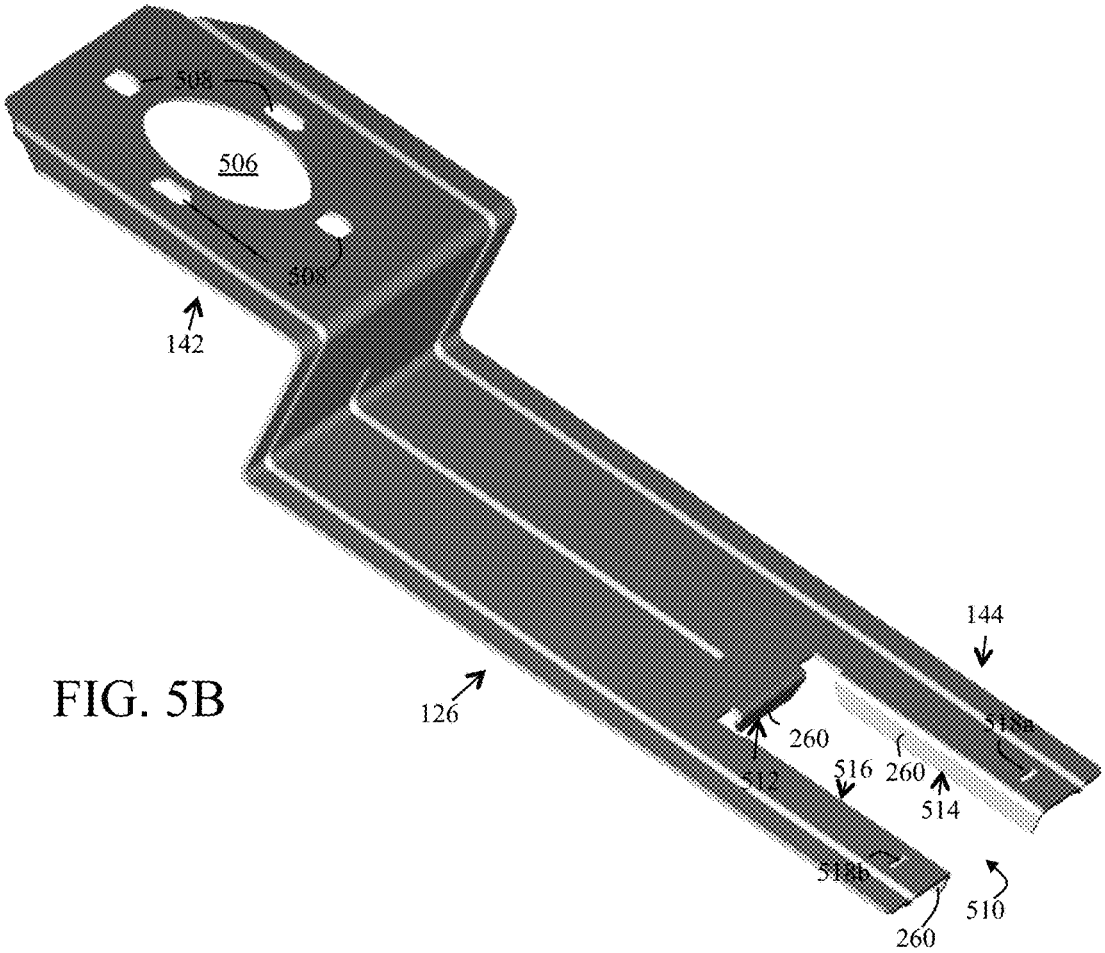
Figure 5C:
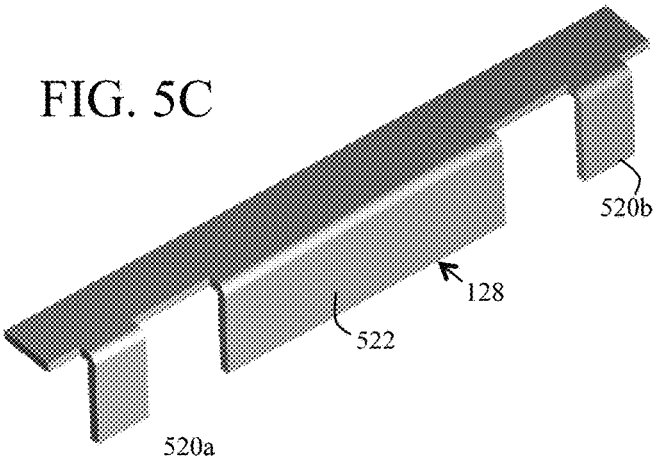
Figure 5D:
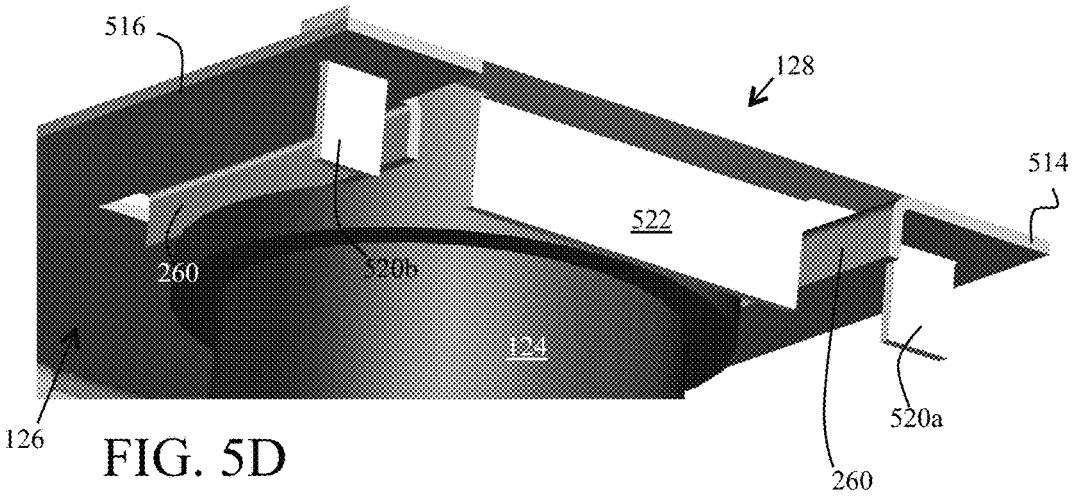

FIG. 4A is a non-limiting, exemplary illustration of an adapter-conduit in accordance with one or more embodiments of present invention. FIGS. 4B and 4C are non-limiting, exemplary illustration of various views of adapter-conduit and fluid displacement mechanism (without showing electrical wiring) in accordance with one or more embodiments of the present invention. FIG. 4D is a non-limiting, exemplary illustration of optional components used for providing covering for adapter-conduit. As illustrated in FIGS. 4A to 4D, adapter-conduit 124 is comprised of a hollow cylindrical structure with a top and a bottom distal ends 224 and 246 with respective top and bottom openings 406 and 402. As indicated above, bottom distal end 246 of bottom opening 402 (FIG. 4C) has an interior bottom periphery 408 that is adapted to be coupled with a reservoir 108. That is, reservoir 104 may be coupled with adapter-conduit 124 through a non-limiting, exemplary threaded coupling that use complementary male-female threading, with reservoir 104 having male threading 222 and adapter-conduit 124 accommodating female threading 404 (FIG. 4C).

As further illustrated in FIGS. 4A to 4D, adapter-conduit 124 also includes a mounting portion 236 protruded from a side of outer surface 408 with holes 240 for coupling with first and second members 214 and 216 of housing 108. First and second members 214 and 216 are coupled with adapter-conduit 124 by aligning first set of apertures 238 of first connection portion 316*a* of first member 214 with holes 240 of mounting portion 236, and inserting the set of cylindrical protrusions 252 of second connection portion 316*b* of second member 216 with blind-holes 330 through holes 240 and securing first and second members 214 and 216 to mounting portion 236 by fasteners fastened through aligned holes 330, 238, and 240. When coupled with mounting portion 236, corresponding set of first and second semi-cylindrical ends 320*a/b* of first and second members 214 and 216 meet to form a cylindrical compartment (FIGS. 3A-1 to 3B-3) for securing tube 210 and tubing nut 228, covering over threaded outlet port 412.

As best illustrated in FIGS. 4A to 4C, adapter-conduit 124 includes a port structure 410 provided within hollow interior of adapter-conduit 124 that has an inlet port 416 (FIG. 4C) associated with tubing 208, and a threaded outlet port 412 (FIGS. 4A and 4B) that extends out of a lateral opening 414 and is associated with the inlet port 418 of pump 206 of fluid displacement mechanism 202 by tubing 210. Tubing nut 228 fastens over threaded outlet port 412 to secure tube 210.

Port structure 410 is comprised of a hollow interior, forming a through-hole between inlet and outlet ports 416 and 412. As illustrated, in this non-limiting exemplary instance, the orientation of inlet port 416 in relation to the orientation of outlet port 412 is non-linear and at an angle to accommodate the non-linear path of flow of fluid, which is a result of non-linear placement or positioning of reservoir 104 in relation to fluid displacement mechanism 202. Additionally, port structure 410 may be an integral part of adapter-conduit 124, forming a single piece component or alternatively, may comprise a separate piece that is positioned within hollow interior of adapter-conduit 124, with outlet port 412 inserted though opening 414 and secured on adapter-conduit 124 with tubing nut 228 fastens over threaded outlet port 412.

Port structure 410 defines a closed-circuit fluid system where fluid is directed to move within designated infrastructure, isolated from remaining components of fluid dispensing system. In other words, fluid is moved from reservoir 104 via tube 208 and into inlet port 416, moving through the through-hole hollow portion of port structure 410, and out and into outlet port 412 of port structure 410 and into tube 210 without contacting interior hollow chamber of adapter-conduit 124.

Referring to FIG. 4D, adapter-conduit 124 may be optionally capped with a lid to cover over and prevent access to opening 406 thereof. As illustrated, adapter-conduit 124 is comprised of top distal end 224 with top opening 406 that has an interior top periphery 420 that may be adapted to receive and secure a detachable female threaded ring 226 for connection with an optional lid-adapter 422 to secure a lid mechanism 424 to cover over opening 406 (and hence, block access to reservoir 104). Ring 226 may snap-fit into interior periphery structure of adapter-conduit 124 and bonded or alternatively, may form an integral part of adapter-conduit 124, forming a single piece. Lid-adapter 422 may comprises a top distal end 440 that has a flange 428 and flat surfaces 446, with top 440 having a top opening 432. Lid-adapter 422 may also include a bottom distal end 442 that is threaded 436, with bottom 442 having a bottom opening 434. Male threads 436 of bottom distal end 442 couples with female threaded ring 226. Lid mechanism 424 is comprised of a securing end 426 that is secured underneath flange 428 of lid-adapter 422, and a lid 430 that is tethered to securing end 426 that covers over and closes access to opening 432. As illustrated, securing end 426 and lid 430 are tethered by a flexible extension 444 that enables lid 430 to move along path 446 and cover over opening 432. If the lid assembly illustrated in FIG. 4D is used, mounting support 226 (further detailed below) may also be coupled with lid-adapter 422, contacting flat surfaces 446 rather than top distal end of adapter-conduit 124 (shown in FIGS. 7A, 7B, and 9). It should be noted that alternatively, the entire lid assembly illustrated in FIG. 4D may be replaced by a simple lid 150 (FIG. 1A) that caps over opening 406, without the need or requirement for lid-adapter 422, tethered lid mechanism 424, or separate threaded ring 226. Further, threaded ring 226 may be an integrally molded part of adapter-conduit 124 rather than a separate piece.

Referring to FIG. 4A, top distal end 224 of adapter-conduit 124 couples with free end 144 of cantilevered suspension bracket 126. Adapter-conduit 124 is comprised of a top outer periphery 448 adapted to be coupled with second (free) end 144 of mounting-support 126 (detailed further below in relation to FIGS. 5A to 5D). In particular, top outer periphery 448 is comprised of indentations 450 with sufficient size (depth, length, and width) to accommodate flanges 260 (FIG. 2A) of second end 144 of mounting support 126 within indentations 450 as best illustrated in FIGS. 1A to 2B, and FIG. 5D, enabling adapter-conduit 124 and the coupled reservoir 104 to be secured in position.

FIGS. 5A to 5D are non-limiting, exemplary illustrations of the various views of mounting support in accordance with one or more embodiments of the present invention. As illustrated, one or more embodiments of fluid dispensing system 100*a* further comprise mounting-support 126 having a first end 142 associated with flow-out member 102, and a second end 144 supporting adapter-conduit 124, nonlinearly positioning reservoir 104 in relation to flow-out member 202 at an axial length 502 of mounting-support 126, and at a desired angle. Further, mounting-support 126 also includes a width 504 with sufficient span to position all components supported by mounting-support 126 (e.g., reservoir 104) away from wall underneath a sink.

Referring to FIGS. 1A, 1B, and 5A to 5D, first end 142 of mounting-support 126 is associated with flow-out member 102, which eliminates the need for drilling holes in the walls to secure the fluid dispensing system 100*a*. In other words, mounting-support 126 enables self-securing fluid dispensing system 100*a* without requirement of direct connection with a wall. Accordingly, the only structure that securely holds fluid dispensing system 100*a* is the countertop 148 with which flow-out member 102 is associated (best shown in FIG. 1A).

First end 142 of mounting-support 126 is comprised a first hole 506 for passing through tube 138 and wiring 112, as illustrated in FIG. 1A. In some cases, first hole 506 may also be used for securing the flow out member 102. This is true when a flow out member is used that employs a large diameter shank used for fastening as well as a conduit for hoses and wires. First end 142 further includes a second set of holes 508 that receive shank fasteners 130 of flow-out member 102 and are positioned around first hole 506 to secure first end 142 to flow-out member 102 through the countertop 148 at a desired orientation to thereby orient and position second end 144 of mounting-support 126 nonlinearly at a desired angle in relation to a structure. In other words, depending on the number of second set of holes 508, the second end 144 of mounting-support 126 may be positioned at an angle in relation to a structure upon which flow-out member 102 is ultimately attached. In this non-limiting exemplary instance, second end 144 of mounting-support 126 shown in FIG. 1A is oriented at 0 or 180 degrees in relation to the illustrated wall, but may be positioned and oriented at any radial position in relation to the wall such as one furthest from the wall or at 90 degrees orientation, which would facilitate in ease of access for removal and refill of reservoir 104. The higher the number of secondary set of holes 508, the greater the number of degrees of orientation and positioning of second end 144.

Second end 144 of mounting-support 126 is comprised an opening 510 defined by three sides 512, 514, and 516 with angled flanges 260 that receive and engage with indentations 450 for mounting adapter-conduit 124. Second end 144 also accommodates a removable barrier 128 that interlocks apertures 518*a/b* of sides 514 and 516 to secure adapter-conduit 124. Removable barrier 128 includes flanges 520*a/b* that may be inserted into apertures 518*a/b* of sides 514 and 516 (best shown in FIG. 5D) to thereby securely lock adapter-conduit 124, and flange 522 that rests within one of the indentations 450 of adapter-conduit 124.

As illustrated in FIGS. 2A, 2B, and 4C and 4D, fluid displacement mechanism 202 may comprise of a combination of a drive mechanism 204 and pump 206, with drive mechanism 204 actuating pump 206 for displacement of fluid. Drive mechanism 204 may be a motor, the actuation of which is under the control of regulator 106, with wiring 112 providing power and data communication between regulator 106, drive mechanism 204, and power source 116/118 in well known manner. Pump 206 used is a well known peristaltic pump that may use silicone rubber tubing, for example. Peristaltic pumps are well known and readily available through many vendors. In general, most peristaltic pumps include an attached drive mechanism or motor and hence, they may be purchased as an integral pump-motor module, which include wiring terminals for connection to power/data for control of the drive mechanism 204 and pump 206 by regulator 106.

Figure 6A:
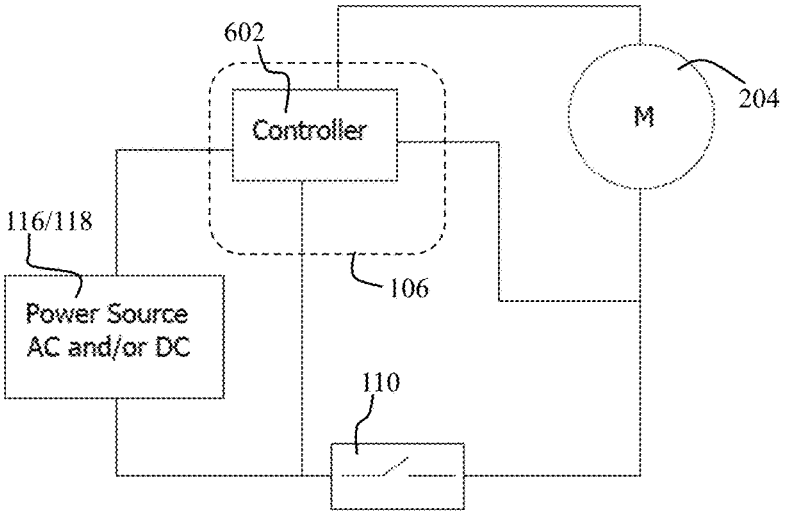
FIG. 6A is a non-limiting, exemplary schematic illustration of a wiring diagram for fluid dispensing system in accordance with one or more embodiments of the present invention.
Figure 6B:
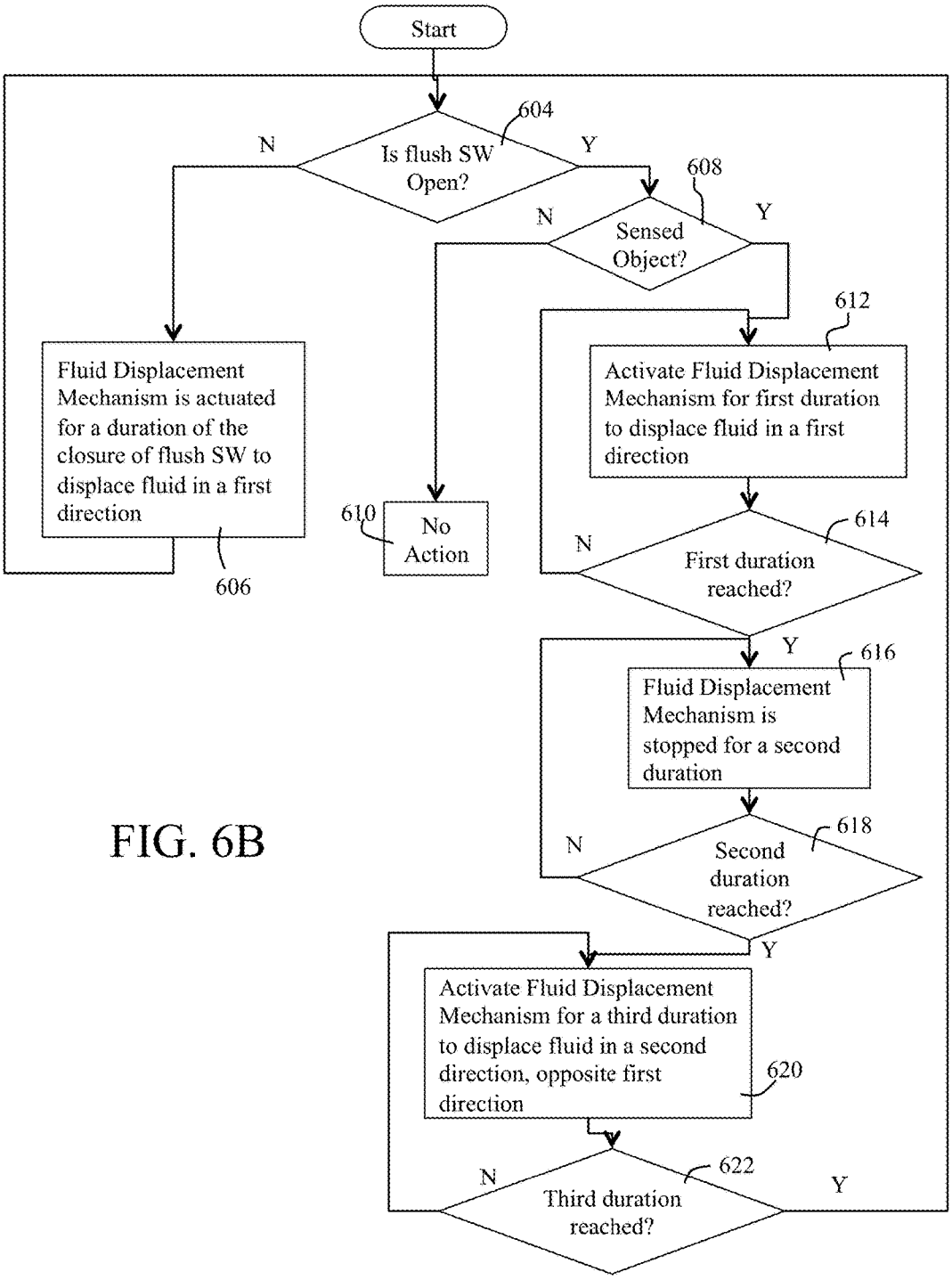
FIG. 6B is a non-limiting, exemplary flowchart for operation of a controller of a regulator in relation to the fluid displacement mechanism, including use of bypass or flush switch in accordance with one or more embodiments of the present invention.
Figures 1, 6C:
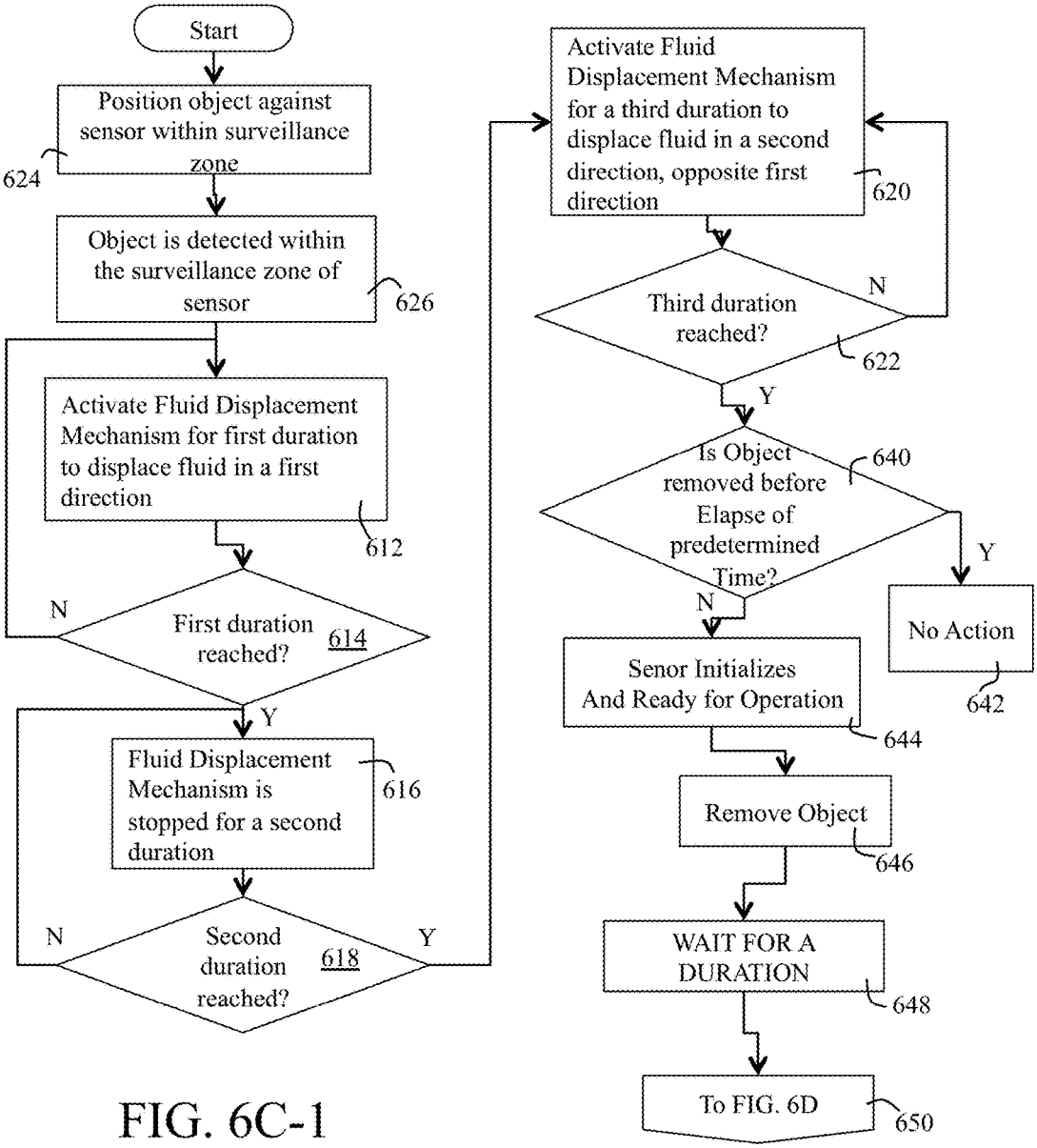
Figures 2, 6C:
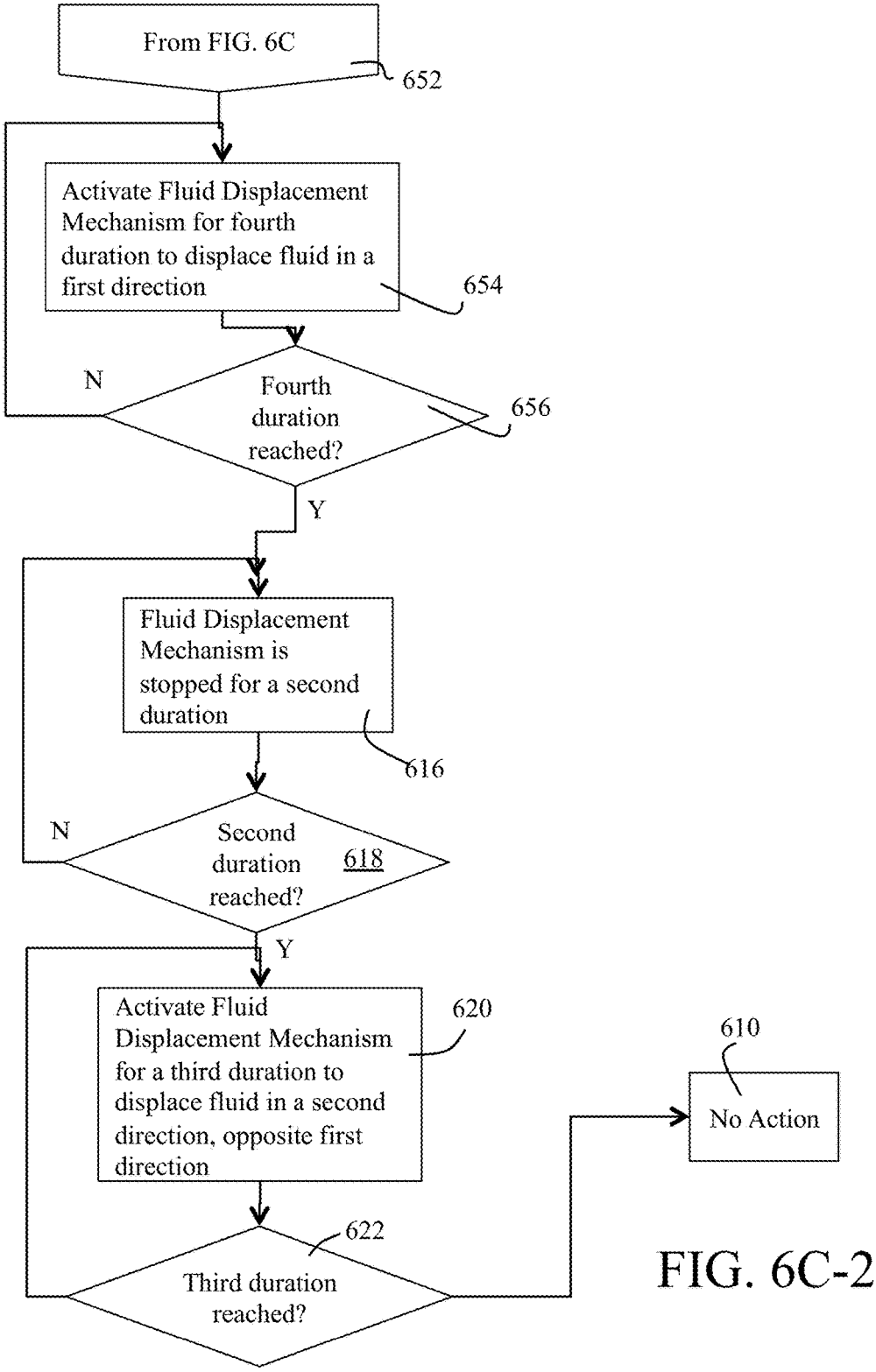

FIG. 6A is a non-limiting, exemplary schematic illustration of a wiring diagram for fluid dispensing system in accordance with one or more embodiments of the present invention, and FIG. 6B is a non-limiting, exemplary flow chart for operation of the controller of the regulator in relation to the fluid displacement mechanism, including use of bypass or flush switch in accordance with one or more embodiments of the present invention, and FIGS. 6C-1 and 6C-2 are a non-limiting, exemplary flowcharts for priming fluid dispensing system without using bypass or flush switch in accordance with one or more embodiments of the present invention. As illustrated in FIG. 6A, an embodiment of the present invention includes a bypass or flush switch 110, which when actuated, directly controls and powers motor 204, bypassing controller 602 of regulator 106. The remaining illustrated electrical wiring shown in FIG. 6A is well known. It should be noted that controller 602 may be a conventional microprocessor unit with conventional electronic support infrastructure such as memory (Read Only Memory-ROM, Random Access Memory-RAM), input/output pins or ports, clock signal generator for operations, etc. that includes a firmware for operation.

In general, a benefit of using peristaltic pumps 206 is that they have a long life and use a flexible tube (a non-limiting example of which may include the use of silicone rubber tubing) within which fluid is transferred. This provides the added benefit that the fluid traverses through a pump tube and is isolated from pump components. In other words, the fluid flowing through fluid displacement mechanism 202 is isolated from drive mechanism 204 and internal components of pump 206, confined within a set of flexible tubes unit it exists the nozzle 134, which is how a peristaltic pump operates.

Regardless of the type of pump mechanism, in general, in most instances, once the fluid exits the nozzle 134, fluid residue may remain at a tip of the nozzle 134 after use, which may accumulate and dry out, clogging nozzle 134 and being a source of bacteria. Referring to FIG. 6B and as detailed below, the present invention provides modified controller scheme that uses a routine to control drive mechanism 204 to retrieve (pull back or backflow) remaining fluid residue after operation of fluid dispensing system. As illustrated, controller 602 of regulator 106 is modified in accordance with one or more embodiments of the present invention so that drive mechanism 204 actuates pump 206 for a first duration to displace fluid in a first direction, and actuates pump 206 for another duration to displace fluid in a second direction, opposite the first direction to thereby retrieve or pull back remaining fluid residue at nozzle 134 after normal operations.

As detailed in FIG. 6B, controller 602 at operation 604 commences fluid displacement operations by determining if bypass or flush switch 110 is actuated (e.g., closed). If controller 602 determines that bypass switch 110 is actuated (e.g., closed—NO route), power is supplied to fluid displacement mechanism 202, bypassing controller 602 and regulator 106 operations. At operation 606, bypass switch 110 powers fluid displacement mechanism 202, which operates for duration of the closure of bypass switch 110 to displace fluid in a first direction. The flush switch 110 may be used to bleed-out air remaining in the system.

If at operation 604 controller 602 determines that bypass switch 110 is not actuated (e.g., open—YES route), at operation 608 controller 602 determines if an object is sensed. An object positioned in front of sensor 106 will be detected within the surveillance zone of sensor 106 at which point, controller 206 would receive the sensed signal and execute operations 612 to 622 as detail further. If controller 602 does not receive a detect signal for a sensed object at operation 608, no further action is taken at operation 610. However, if controller 602 does received a detect signal for a sensed object at operation 608 by an exemplary IR detector, at operation 612 controller 602 activates fluid displacement mechanism 202 for a first duration to displace fluid in a first direction. At this point, fluid is moved from reservoir 104 and is dispensed from nozzle 134 for a first duration. Thereafter, at operation 614 controller 602 determines if a first duration is reached and if so, at operation 616 controller 602 stops fluid displacement mechanism 202 for a second duration and at operation 618 determines if a second duration is reached. After an end of second duration at operation 618, controller 602 at operation 620 activates fluid displacement mechanism 202 for a third duration to displace fluid in a second direction, opposite the first direction and at operation 622 determines if a third duration is reached. This enables backflow of fluid residue at nozzle 134 back into the nozzle 134 and hose 138 partially located inside flow-out member 102. Accordingly, pump 206 is controlled to displace fluid for a first duration in a first direction, then is stopped for a second duration, and finally is controlled to displace fluid for a third duration in a second direction, opposite the first direction to thereby retrieve or pull back remaining fluid residue at nozzle 134 after normal operations.

Therefore, in accordance with one or more embodiments of the present invention, driving peristaltic pump 206 in a second direction for a third duration will pull in the residue material left within the tube. Accordingly, drive mechanism 204 actuates pump 206 for a first duration to displace fluid in a first direction for dispensing, and eventually actuates pump 206 for another duration to displace fluid in a second direction for retraction (or backflow) of fluid (which is opposite the first direction).

It should be noted that the third duration for pump reversal is sufficiently short period of time (much shorter than the first duration) so that only the small amount of residue (if any) that may potentially ooze out at nozzle 134 is pulled back into the tube 138. Further, any fluid that is at or near the reservoir 104 (or that had just left the reservoir 104) at the egress of reservoir (or ingress of the tubing 208) may be returned into the reservoir 104. Accordingly, generally, no part of the fluid that is returned into reservoir 104 is exposed to the external environment.

It should further be noted that since pump 206 is reversed, the present invention does not use a check (or one-way) valve in fluid displacement mechanism 202. In general, prior art uses check valves within most pumping mechanism to allow fluid to flow through it in only one direction, while blocking backflows. However, placement of a check valve would defeat the purpose of driving peristaltic pump 206 in the second direction to clear nozzle 134 from any remaining residue.

As indicated above, FIGS. 6C-1 and 6C-2 are non-limiting, exemplary flowcharts for priming fluid dispensing system without using bypass or flush switch in accordance with one or more embodiments of the present invention. In general, when a user has completed fluid re-fill of reservoir 104, the user needs to prime or prepare the system, which is to flush the fluid in order to get fluid up from fluid reservoir to fluid dispensing nozzle while bleeding out remaining air. This may be accomplished by using the flush or bypass switch 110 (as detailed in FIG. 6B) or alternatively, as indicated in FIGS. 6C-1 and 6C-2 without using the bypass or flush switch 110.

Referring to FIGS. 6C-1 and 6C-2, to avoid using the bypass or flush switch 110 (for example, the user does not wish to access under the sink, they may instead first position and place an object against sensor 106 within the surveillance zone of sensor 106 as indicated by user step 624. For example, an object such as a towel may be wrapped around or positioned in front of sensor 106 within sensor surveillance zone. As indicated at operation 626, object placed in front of sensor 106 will be detected within the surveillance zone of sensor 106 at which point, controller 206 receiving the sensed signal and executes operations 612 to 622 as described in detail with respect to FIG. 6B. However, after operation 622, controller 206 via sensor 106 at operation 640 determines if object is removed before elapse of predetermined time. If object is removed quickly (before elapse of a predetermined time), no further action is taken as indicated at operation 642. However, if at operation 640 controller 206 determines that the object is not removed before elapse of the predetermined time, controller 206 at operation 644 initializes sensor 106 and enables output of indicators (e.g., LED lights, etc.) that system is ready for operation. Thereafter, user may remove the object as indicated in the user step 646, after which, controller 206 at operation 648 allows a predetermined time to elapse before further execution of the remaining operations (detailed in FIG. 6C-2). This delay operation 648 provides users with time to clear the flow-out member spill zone (where fluid is actually poured onto). For example, while removing object at operation 646, it would not be desirable to commence operation 654 (FIG. 6C-2, detailed below).

Referring to FIG. 6C-1, once a predetermined time has elapsed at operation 648, controller 206 at operation 654 (FIG. 6C-2) activates fluid displacement mechanism for a fourth duration to displace fluid in a first direction. In general, the fourth duration is the longer of all durations, which would allow fluid to travel from reservoir (recently refilled by user) and exist out of nozzle 134. This primes the system by flushing out fluid and bleeding out remaining air therein. Thereafter, at operation 656 controller 602 determines if fourth duration has been reached and if so, operations 616 to 622 are executed as described above in relation to FIG. 6B, where at operation 610 the entire system becomes ready for use.

Figure 6D:
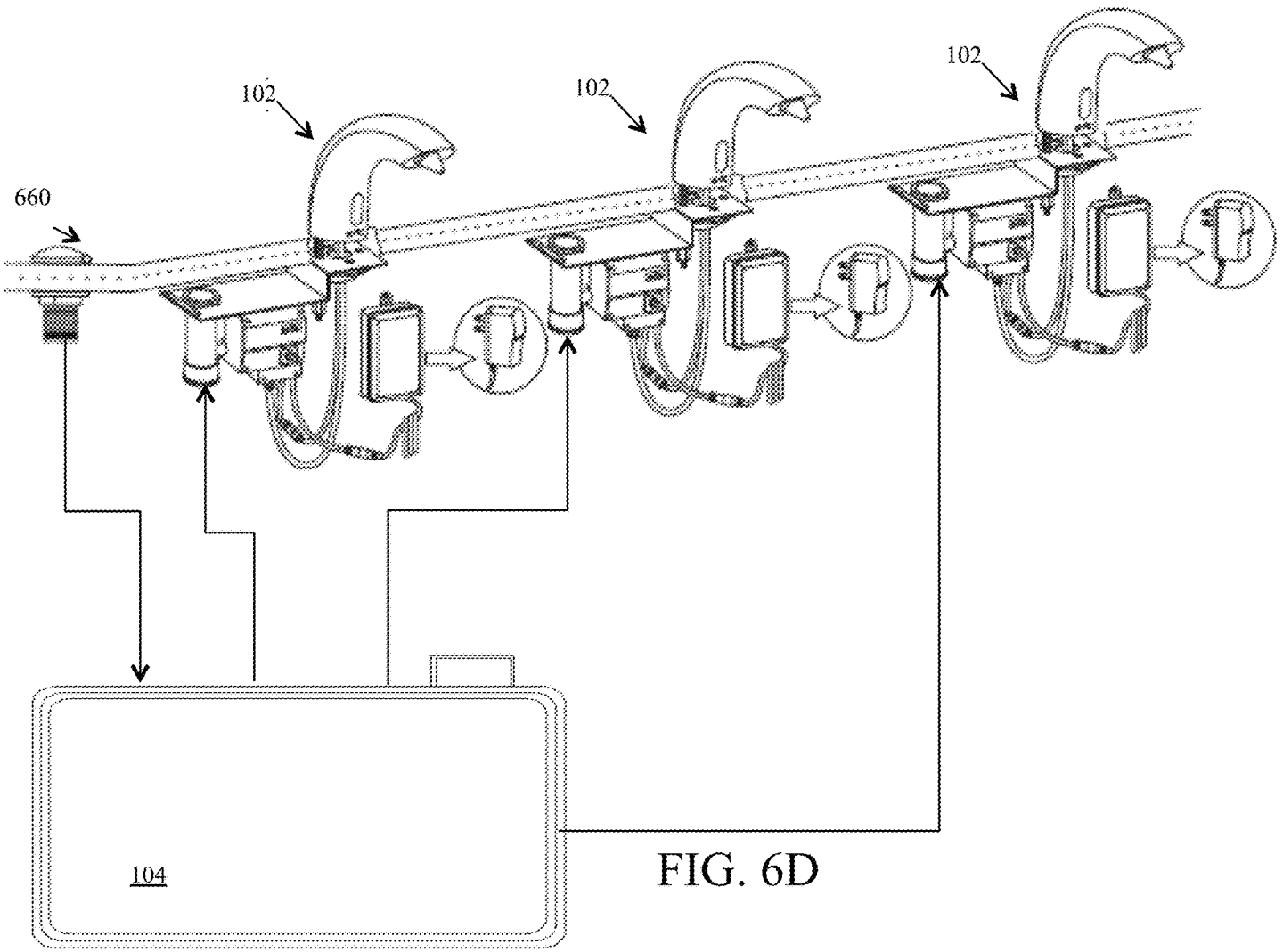
FIG. 6D is a non-limiting, exemplary illustration of a fluid dispensing system that uses a single reservoir with multiple displacement mechanisms, flow-out member, top fill ports, power sources, etc. in accordance with one or more embodiments of the present invention.

FIG. 6D is a non-limiting, exemplary illustration of a fluid dispensing system shown in FIGS. 1A and 1B that uses a single reservoir with multiple displacement mechanisms, flow-out members, top fill ports, power sources, etc. in accordance with one or more embodiments of the present invention. One or more flow-out members 102 may be associated with a single reservoir 104 that may or may not be located remote from the rest of the system. Further, the present invention may use a single or multiple top fill ports 660 to refill the reservoir 104 (only a single fill port 660 is illustrated). Additionally a single power source may be used for all of the units shown in FIG. 6D instead of an individually dedicated power source for each unit as shown.

Figure 7A:
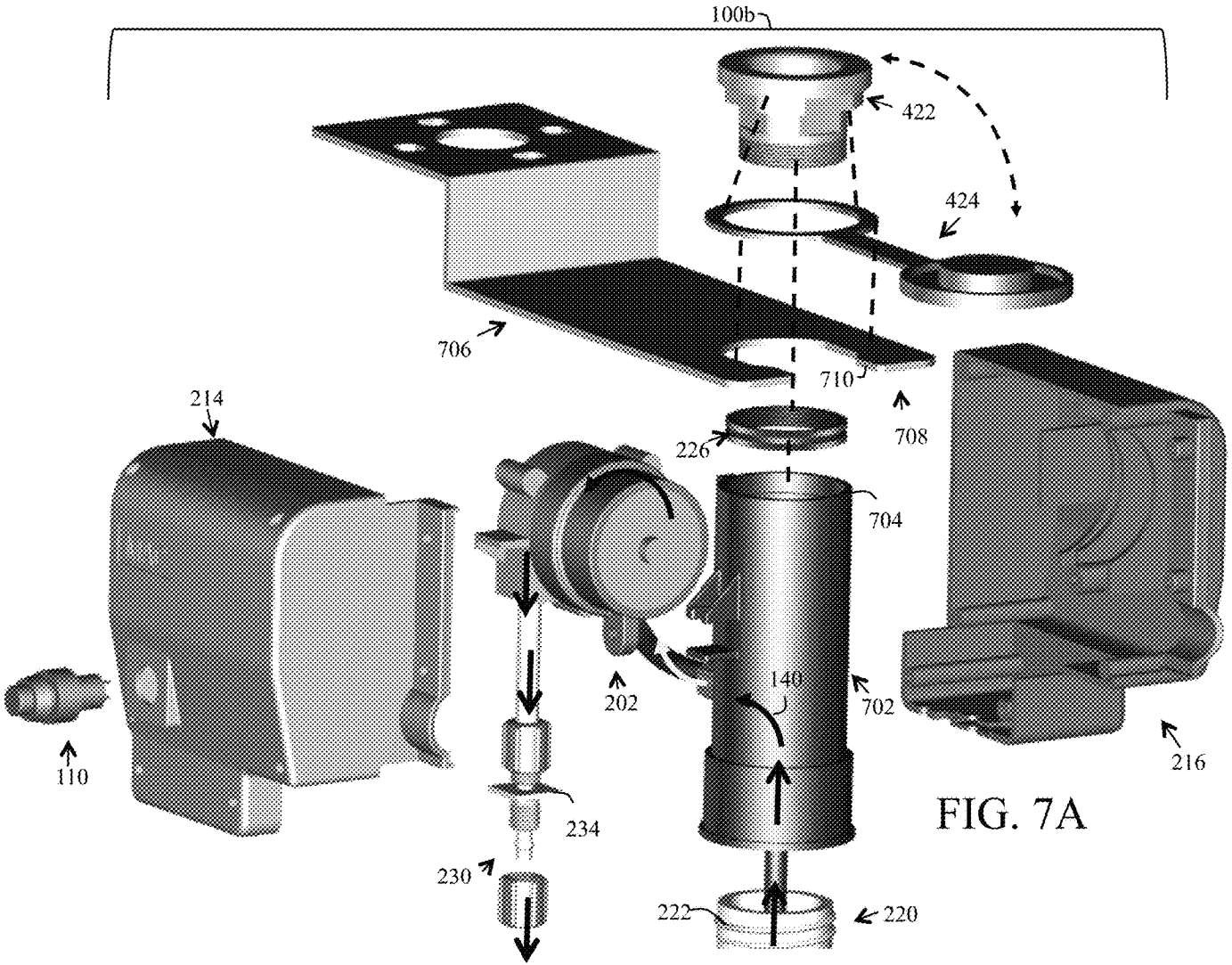
FIGS. 7A and 7B are non-limiting, exemplary front and rear exploded views of a fluid dispensing system in accordance with one or more embodiments of the present invention.
Figure 7B:
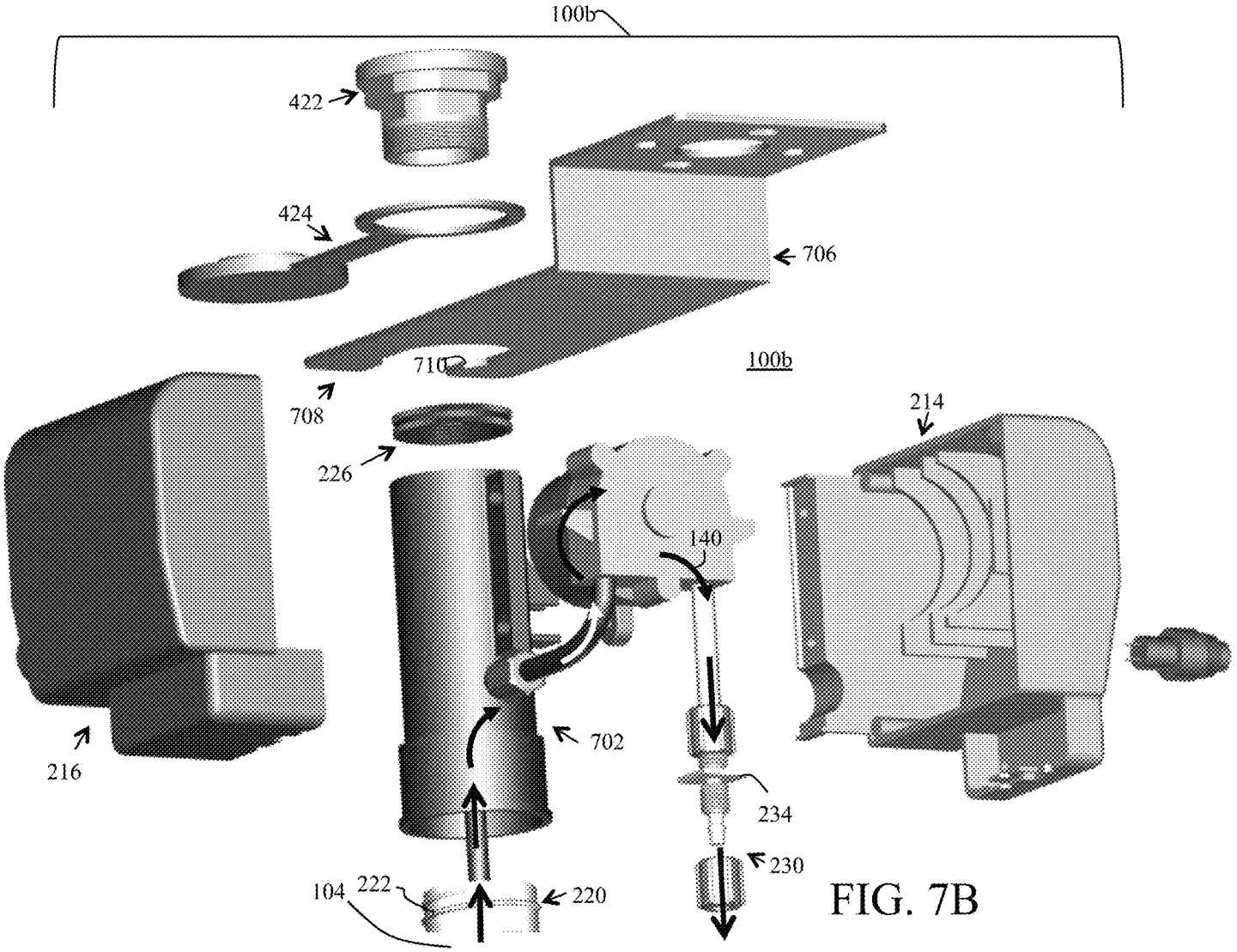

FIGS. 7A and 7B are non-limiting, exemplary front and rear exploded views of a fluid dispensing system in accordance with one or more embodiments of the present invention. Fluid dispensing system **100*b* illustrated in FIGS. 7A and 7B includes similar corresponding or equivalent components, interconnections, functional, operational, and or cooperative relationships as fluid dispensing system 100*a* that is shown in FIGS. 1A to 6D, and described above. Therefore, for the sake of brevity, clarity, convenience, and to avoid duplication, the general description of FIGS. 7A and 7B will not repeat every corresponding or equivalent component, interconnections, functional, operational, and or cooperative relationships that has already been described above in relation to fluid dispensing system 100*a* that is shown in FIGS. 1A to 6D. FIG. 7A is non-limiting, exemplary exploded front perspective view of a fluid dispensing system in accordance with one or more embodiments of the present invention, and FIG. 7B is non-limiting, exemplary exploded rear perspective view of the fluid dispensing system shown in FIG. 7A in accordance with one or more embodiments of the present invention. As illustrated in FIGS. 7A and 7B, in this non-limiting, exemplary embodiment of the present invention, fluid dispensing system 100***b* includes an adapter-conduit 702 that is comprised of a top outer periphery 704 that is cylindrical with no indentations. In addition, in this non-limiting, exemplary embodiment a mounting support 706 is provided that includes a second end 708 with edges 710 that receive lid-adapter 422 and abut against and underneath securing end 426 of lid mechanism 424 when fully assembled.

Figure 8A:
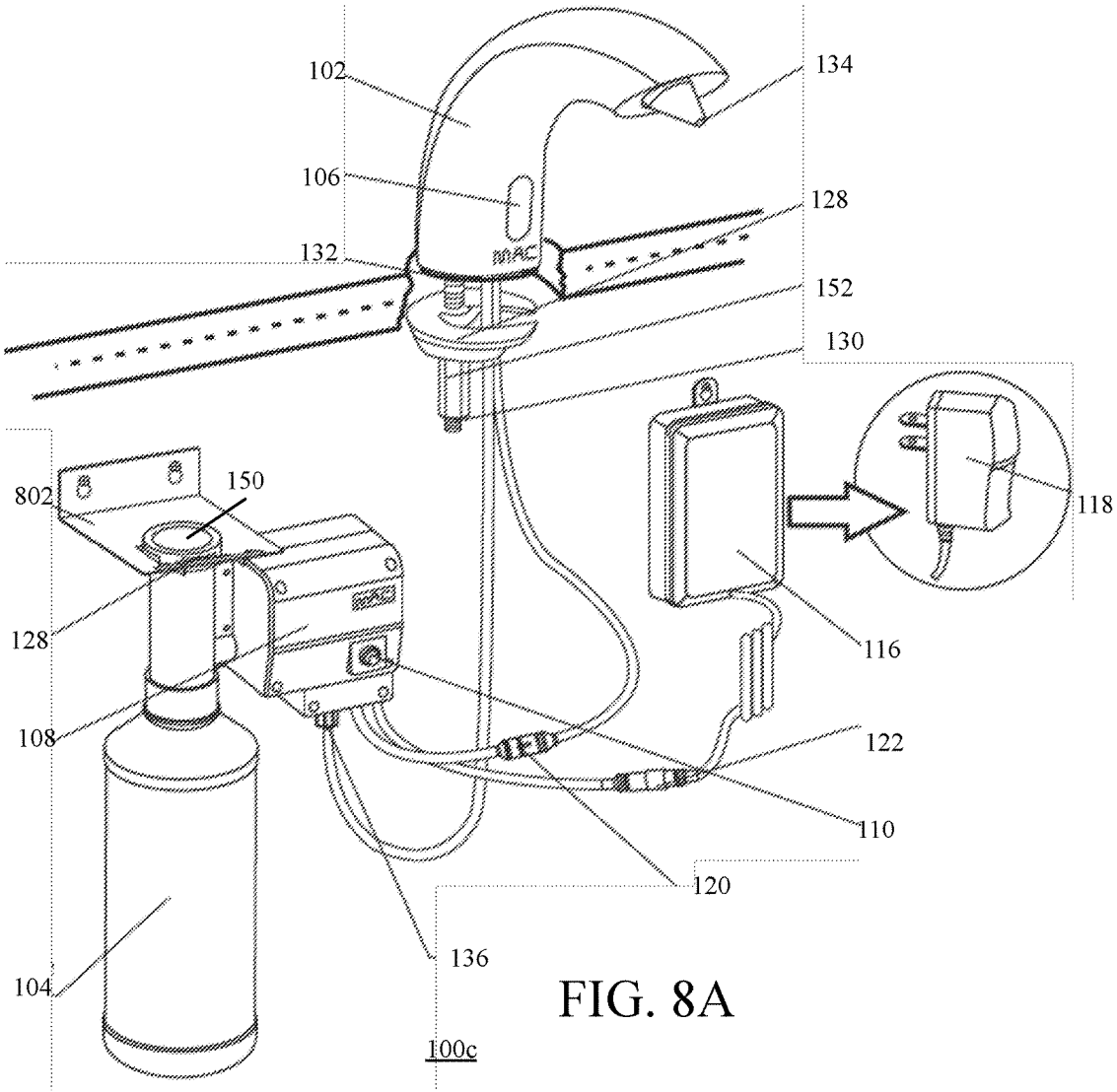
FIGS. 8A and 8B are non-limiting, exemplary illustrations of a fluid dispensing system using a wall mount mounting support in accordance with one or more embodiments of the present invention.
Figure 8B:
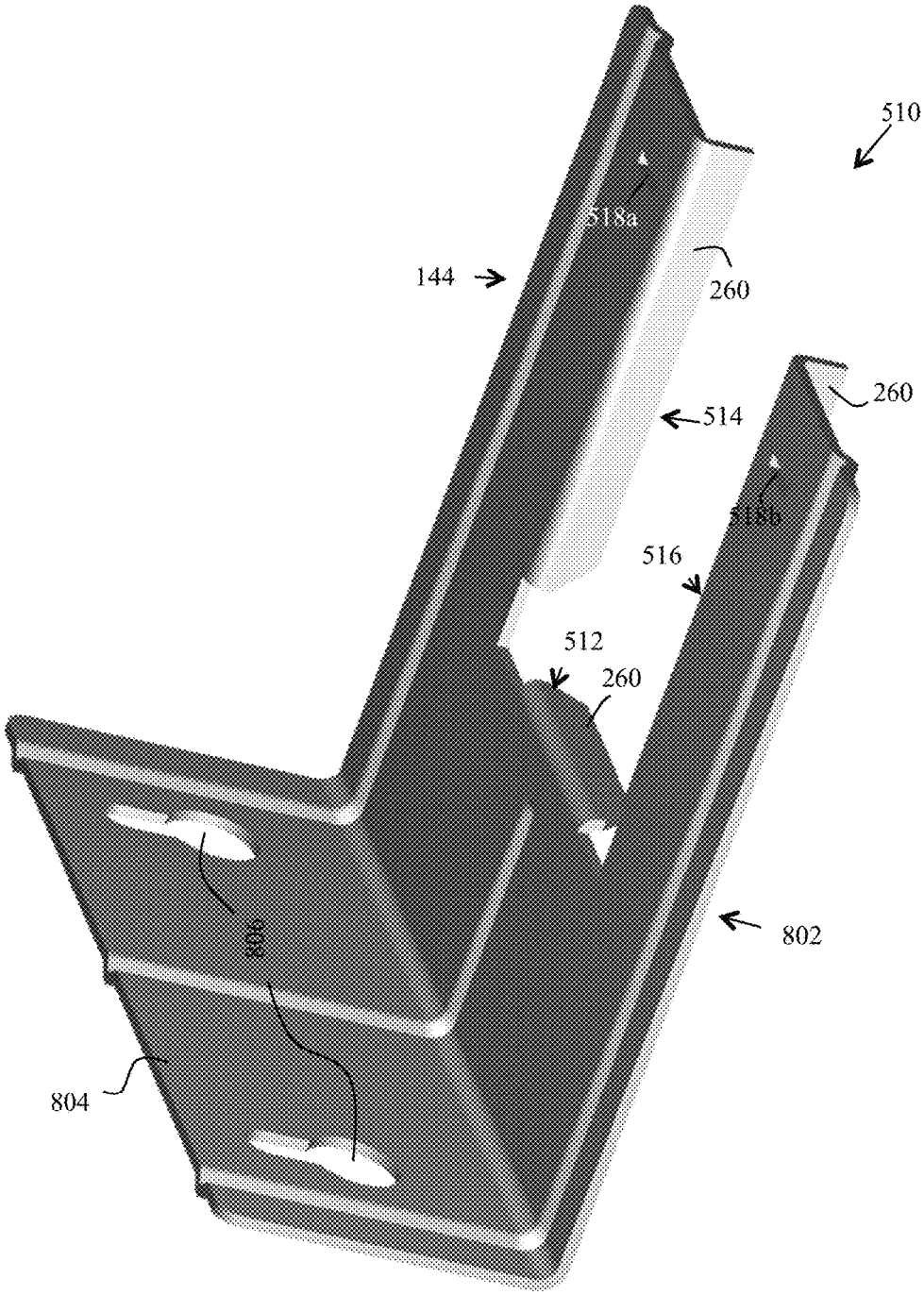

FIGS. 8A and 8B are non-limiting, exemplary illustrations a fluid dispensing system using a wall mount mounting support in accordance with one or more embodiments of the present invention. The fluid dispensing system 100*c* illustrated in FIGS. 8A and 8B includes similar corresponding or equivalent components, interconnections, functional, operational, and or cooperative relationships as fluid dispensing system 100*a* and 100*b* that is shown in FIGS. 1A to 7B, and described above. Therefore, for the sake of brevity, clarity, convenience, and to avoid duplication, the general description of FIGS. 8A and 8B will not repeat every corresponding or equivalent component, interconnections, functional, operational, and or cooperative relationships that has already been described above in relation to fluid dispensing system 100*a* and 100*b* that is shown in FIGS. 1A to 7B. As illustrated in FIGS. 8A and 8B, in this non-limiting, exemplary embodiment of the present invention, fluid dispensing system 100*c* includes a mounting support 802 that is cantilevered on a wall rather than associated with flow-out member 102. As best illustrated in FIG. 8B, mounting support 802 is comprised of a first end 804 with connection holes 806 that enable the mounting support 802 to be connected to a structure such as a wall using fasteners, and second free end 144 that is identical to mounting support 126, which may optionally use removable barrier 128. It should be noted that in this non-limiting, exemplary instance, adapter-conduit 124 top opening 406 may be optionally capped with a simple lid 150 as shown in FIG. 8A.

Figure 9:
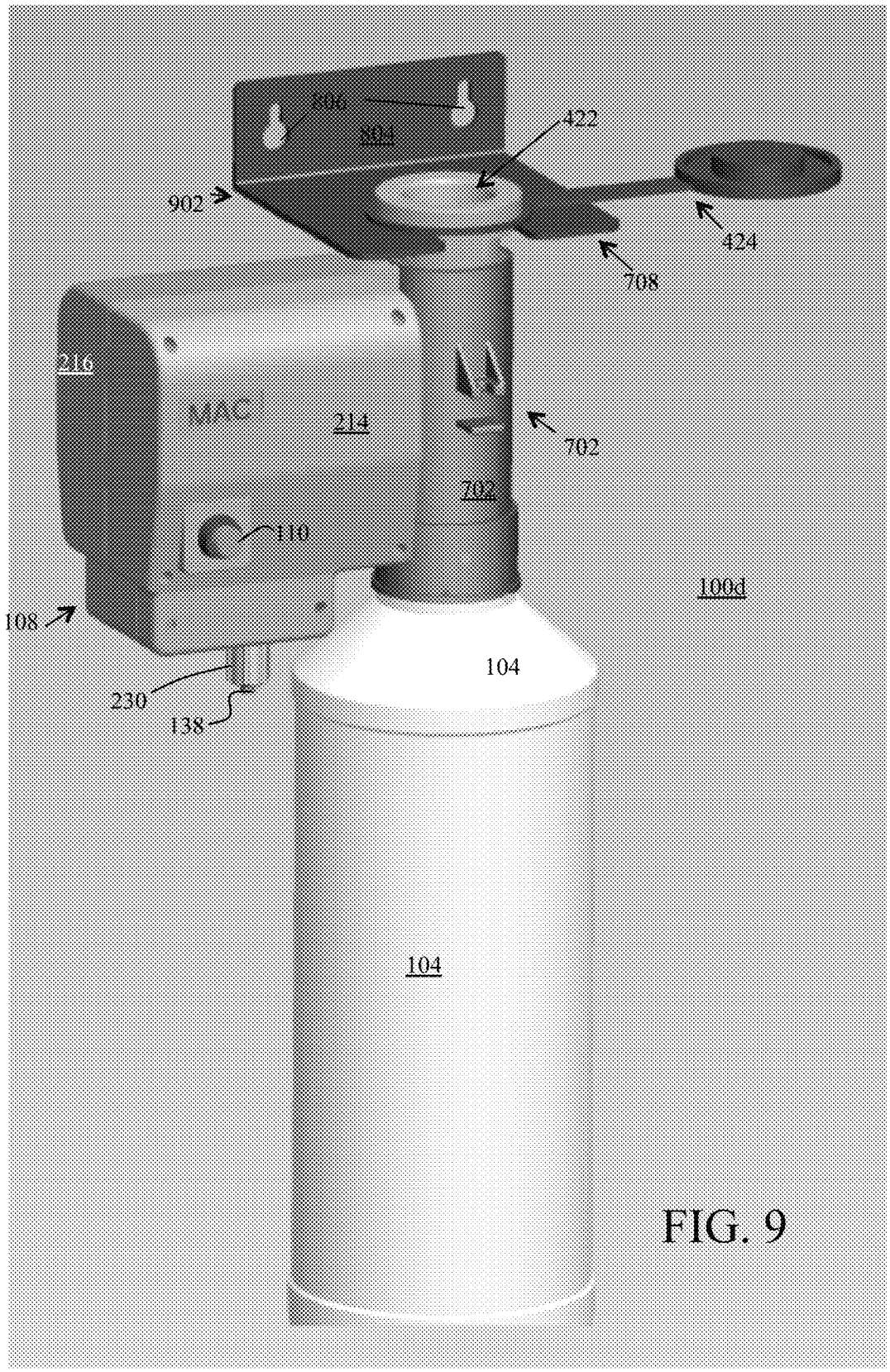
FIG. 9 is non-limiting, exemplary illustrations of a fluid dispensing system using a wall mount mounting support and lid configuration in accordance with one or more embodiments of the present invention.
Figure 10A:
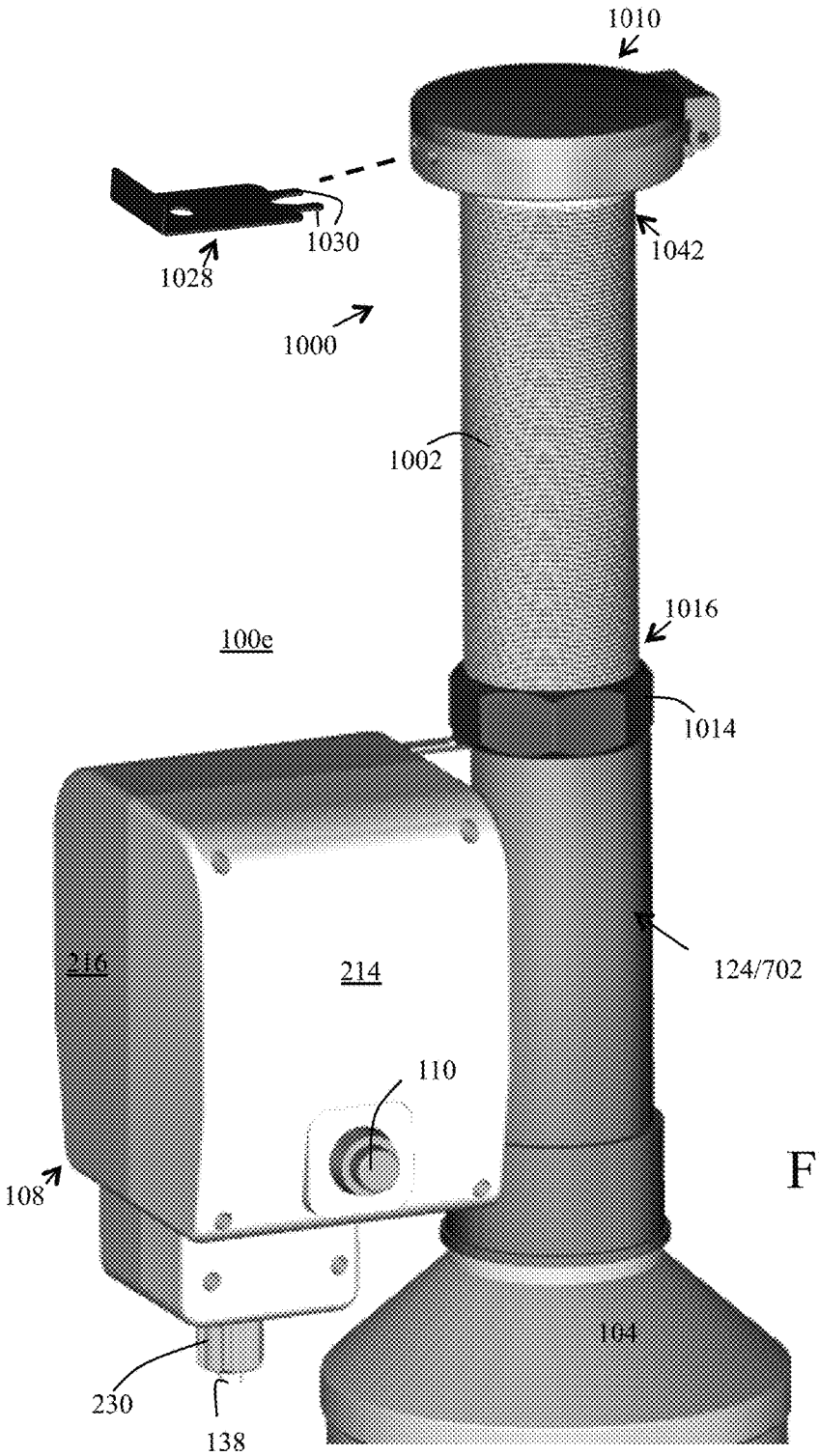
FIGS. 10A to 10E are non-limiting, exemplary illustrations a fluid dispensing system using a top fill-port in accordance with one or more embodiments of the present invention.
Figures 10B, 10D:
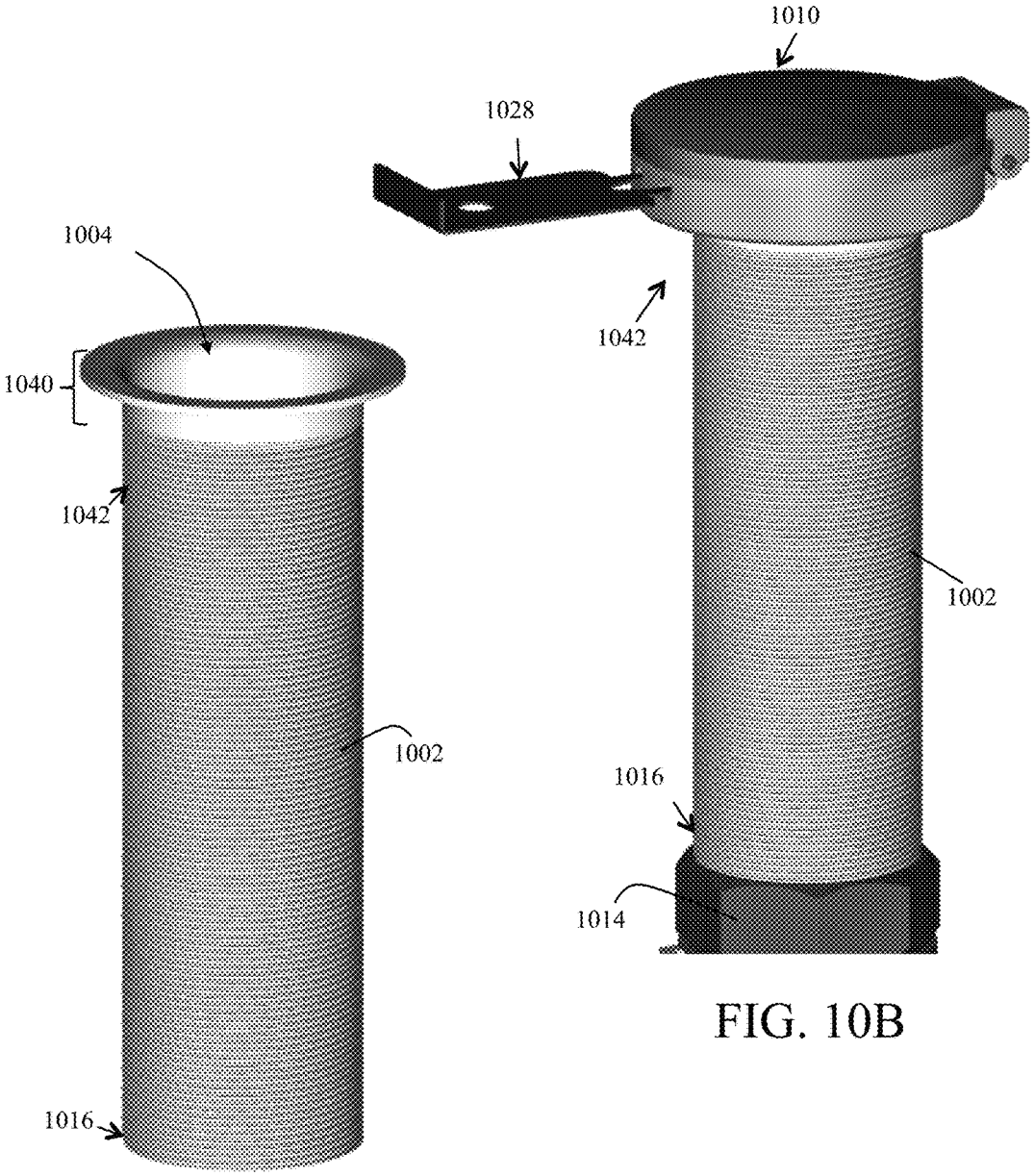
Figure 10C:
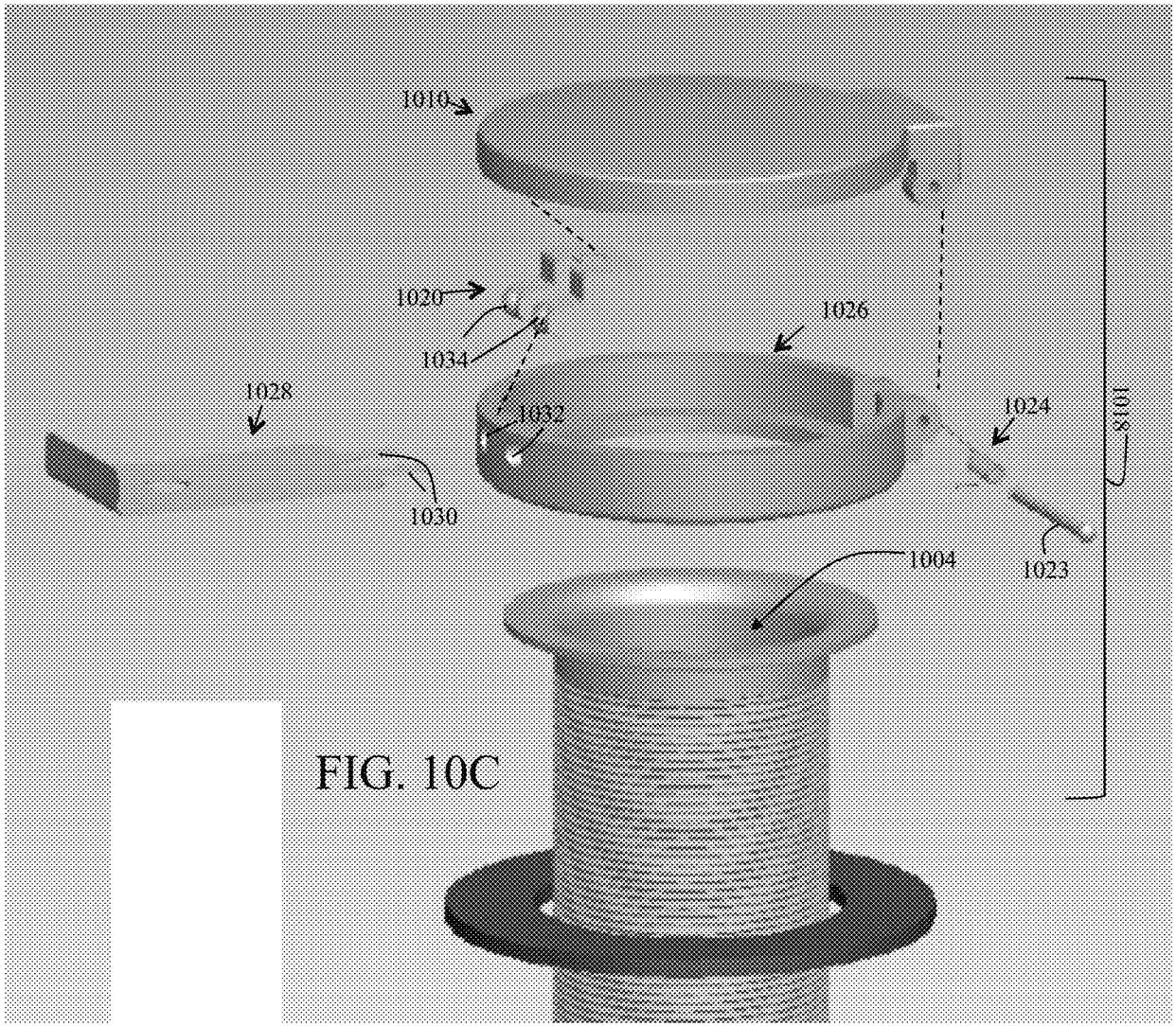
Figure 10E:
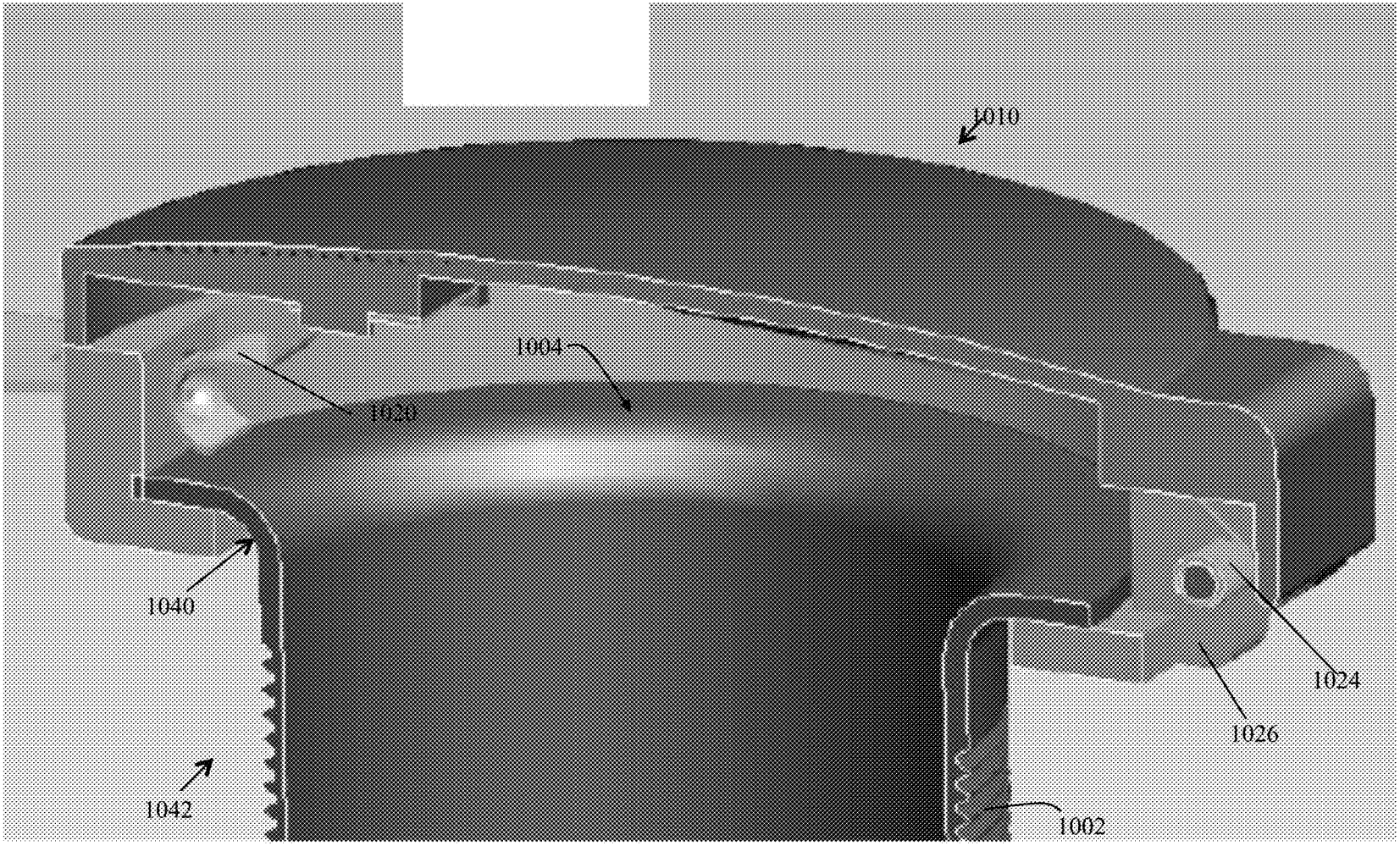

FIG. 9 is non-limiting, exemplary illustration of a fluid dispensing system using a wall mount mounting support and lid configuration in accordance with one or more embodiments of the present invention. The fluid dispensing system 100*d* illustrated in FIG. 9 includes similar corresponding or equivalent components, interconnections, functional, operational, and or cooperative relationships as fluid dispensing system 100*a*, 100*b*, and 100*c* that is shown in FIGS. 1A to 8B, and described above. Therefore, for the sake of brevity, clarity, convenience, and to avoid duplication, the general description of FIG. 9 will not repeat every corresponding or equivalent component, interconnections, functional, operational, and or cooperative relationships that has already been described above in relation to fluid dispensing system 100*a*, 100*b*, and 100*c* that is shown in FIGS. 1A to 8B. As illustrated in FIG. 9, in this non-limiting, exemplary embodiment of the present invention, fluid dispensing system 100*d* includes a mounting support 902 that is cantilevered on a wall rather than associated with flow-out member 102, with a second end 708.

FIGS. 10A to 10E are non-limiting, exemplary illustrations a fluid dispensing system using a top fill-port in accordance with one or more embodiments of the present invention. The fluid dispensing system 100*e* illustrated in FIGS. 10A to 10E includes similar corresponding or equivalent components, interconnections, functional, operational, and or cooperative relationships as fluid dispensing system 100*a*, 100*b*, 100*c*, and 100*d* that is shown in FIGS. 1A to 9, and described above. Therefore, for the sake of brevity, clarity, convenience, and to avoid duplication, the general description of FIGS. 10A to 10E will not repeat every corresponding or equivalent component, interconnections, functional, operational, and or cooperative relationships that has already been described above in relation to fluid dispensing system 100*a*, 100*b*, 100*c*, and 100*d* that is shown in FIGS. 1A to 9. As illustrated in FIGS. 10A to 10E, in this non-limiting, exemplary embodiment of the present invention, reservoir 104 of fluid dispensing system 100*e* may be refilled through a countertop fill port 1000 without removal of reservoir 104, with the countertop fill port 1000 extending out of countertop 148 (FIG. 1A) of a vanity. It should be noted that the refill fluid will not contact any part of the fluid dispensing system, with the exception of passing through an extender 1002, flowing through the internal hollow chamber of adapter-conduit 124/702, passing over exterior of port structure 410, and into reservoir 104. Countertop fill port 1000 includes hollow, threaded shank or extender 1002 that has sufficient height that extends from the coupled adapter-conduit 124/702 and out and onto the vanity countertop 148. As detailed below, extender 1002 also includes a lid 1010 that may be used to cover over top opening 1004 of the countertop fill port 1000.

Extender 1002 is generally threaded from outside and spans from adapter-conduit 124/702 passing through the thickness of the material of countertop 148 and out thereof. In general, optionally, the extender 1002 may also be coupled with the countertop 148 for a more secure connection. Extender 1002 includes a top 1040 that has a top opening 1004 that extends out of the body of countertop 148 and is covered over and capped by lid 1010. In general, extender 1002 includes a fastener 1014 for coupling extender lower end 1016 with adapter-conduit 124/702. It should be noted that lower end 1016 may be fastened onto female threaded ring 226 of adapter-conduit 124/702 and further secured therein by fastener 1014.

Countertop fill port 1000 may include a lid 1010 to prevent vandalism and also, debris from entering into the fluid dispensing system 100*e* and more particularly, into reservoir 104 via extender opening 1004 and through adapter-conduit 124/702. Lid 1010 may comprise of a simple cap that covers over opening 1004 or may include the illustrated latch-lock mechanism 1018 for commercial use.

In general, latch-lock mechanism 1018 of lid 1010 may preferably be lockable if used in commercial setting and is comprised of a latch 1020 associated with lid 1010 that maintains lid 1010 in locked position with a retainer 1026 against the bias of a resilient member 1024 (secured by hinge pin 1023), and is unlocked using a key 1028. Key 1028 has two prongs 1030 that are inserted through commensurate set of holes 1032 of retainer 1026 to push away latch member protrusions 1034 from holes 1032 of retainer member 1026 (or the "keeper"), which pop opens lid 1010 due to force of resilient member 1024. It should be noted that lid 1010 may be secured by any other well-known latch-lock mechanism 1018 and should not be limited to the illustrated latch-lock mechanism. To install latch-lock mechanism 1018, extender 1002 is dropped through an assembled lid-retainer combination (with lid in fully open position) at lower end 1016 of extender 1002, with the extender then coupled from lower end 1016 to adapter-conduit 124/702. After fully installed, retainer-lid combination may be rotate to any orientation desired.

FIGS. 11A to 11D-5 are non-limiting, exemplary illustrations of a fluid dispensing system using an extended fill-port directly associated with a flow-out member in accordance with one or more embodiments of the present invention. The fluid dispensing system 100*f* illustrated in FIGS. 11A to 11D-5 includes similar corresponding or equivalent components, interconnections, functional, operational, and or cooperative relationships as fluid dispensing system 100*a*, 100*b*, 100*c*, 100*d*, and 100*e* that is shown in FIGS. 1A to 10E, and described above. Therefore, for the sake of brevity, clarity, convenience, and to avoid duplication, the general description of FIGS. 11A to 11D-5 will not repeat every corresponding or equivalent component, interconnections, functional, operational, and or cooperative relationships that has already been described above in relation to fluid dispensing system 100*a*, 100*b*, 100*c*, 100*d*, and 100*e* that is shown in FIGS. 1A to 10L. As illustrated in FIGS. 11A to 11D-5, in this non-limiting, exemplary embodiment of the present invention, flow-out member 102 is moved to allow access to countertop fill port 1000. That is, flow-out member 102 is moved away from over the top of countertop fill port 1000 to an open position (FIGS. 11B and 11C) with full access to countertop fill port 1000 to thereby allow refill of reservoir 104, with fluid moving along path 1162, through adapter-conduit 124/702, and into reservoir 104. The benefits of providing countertop fill port 1000 directly underneath a moveable flow-out member 102 is that only a single hole would be required to be provided on countertop 148 for the entire fluid dispensing system 100*f* rather than the conventional two holes, where one hole would be used to mount flow-out member and the other hole would be to access a fill port to refill reservoir 104. This provides an overall aesthetically pleasing look and feel in addition to lower overall cost of installation, including less intrusive damage to countertop 148 (an extra dedicated hole for the countertop fill port 1000 is no longer required).

The movement of flow-out member 102 from closed position (FIG. 11A) to a fully open position (FIGS. 11B and 11C) may be as illustrated, which is tilting (as shown by arrows 1108) of flow-out member 102 to a side (right, left, front, back, and or some other angle other than 90 degree quadrants). Alternatively, flow-out member 102 may simply pivot (off-axis as shown by arrow 1102) and be twisted about a longitudinal axis 1104 (central or eccentric) while rotated (as shown by arrow 1106) and pulled away from over the top of countertop fill port 1000 to an open position. Accordingly, the movement of flow-out member 102 to open access to countertop fill port 1000 should not be limited to the illustrated tilting motion, but may vary, for example, by it being completely pulled away from the counter adapter.

As further illustrated, a lower end 1110 of flow-out member 102 may be associated with a hinge mechanism 1112 that enables a movement of flow-out member 102. Any suitable type of hinge mechanisms (with or without an additional latch mechanism) that enables movement of the flow-out member 102 may be used. In this non-limiting, exemplary embodiment the illustrated hinge mechanism 1112 (best shown in FIG. 11B) is comprised of first and second O-ring leaf 1114 and 1116 connected together by pin 1118 and barrel 1120 combination. Hinge mechanism 1112 has minimal number of connection points for coupling O-ring leafs 1114 and 1116 respective with lower end 1110 of flow-out member 102 and countertop adapter 1124, which enables hinge mechanism 1112 to be universally mounted to most types and styles of flow-out member 102.

First O-ring leaf 1114 of hinge mechanism 1112 is coupled with a lower end 1110 of flow-out member 102 by a set of fasteners, with the remaining upper part of flow-out member 102 isolated by a non-corrosive material ring 1122, protecting flow-out member 102 from excess soap residue. Second O-ring leaf 1116 is coupled with countertop adapter 1124, which is connected to the top of countertop fill port 1000 and countertop 148. It should be noted that in this non-limiting, exemplary embodiment, extender 1002 of countertop fill port 1000 may be an externally threaded, hollow shank without third section 1040. Additionally, in this non-limiting, exemplary embodiment, hinge mechanism 1112 incorporates a well known type of a latch mechanism 1126 to detachably latch flow-out member securely onto countertop adapter 1124.

Figure 11A:
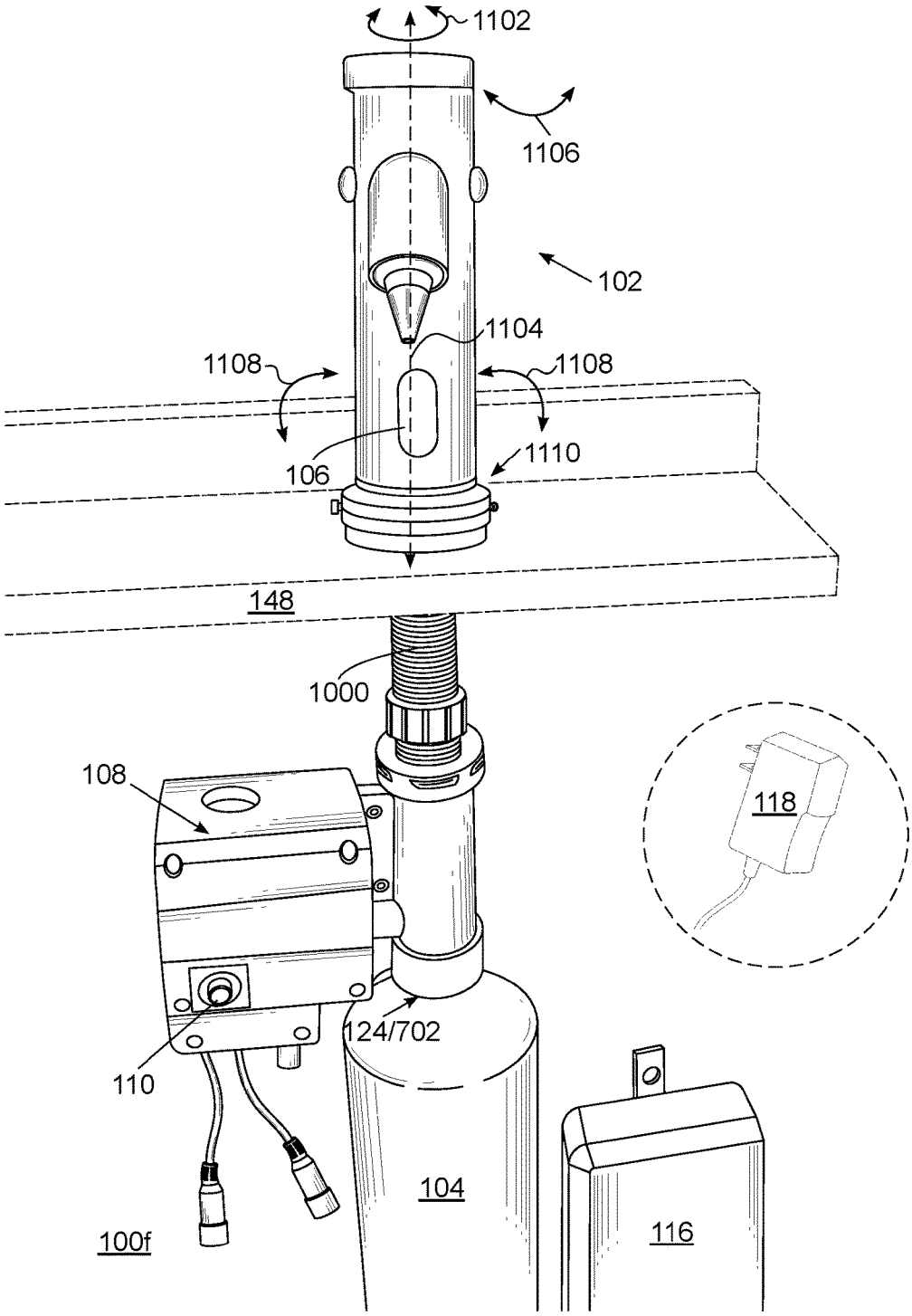
FIGS. 11A to 11D-5 are non-limiting, exemplary illustrations of a fluid dispensing system using an extended fill-port directly associated with a movable flow-out member in accordance with one or more embodiments of the present invention.
Figure 11B:
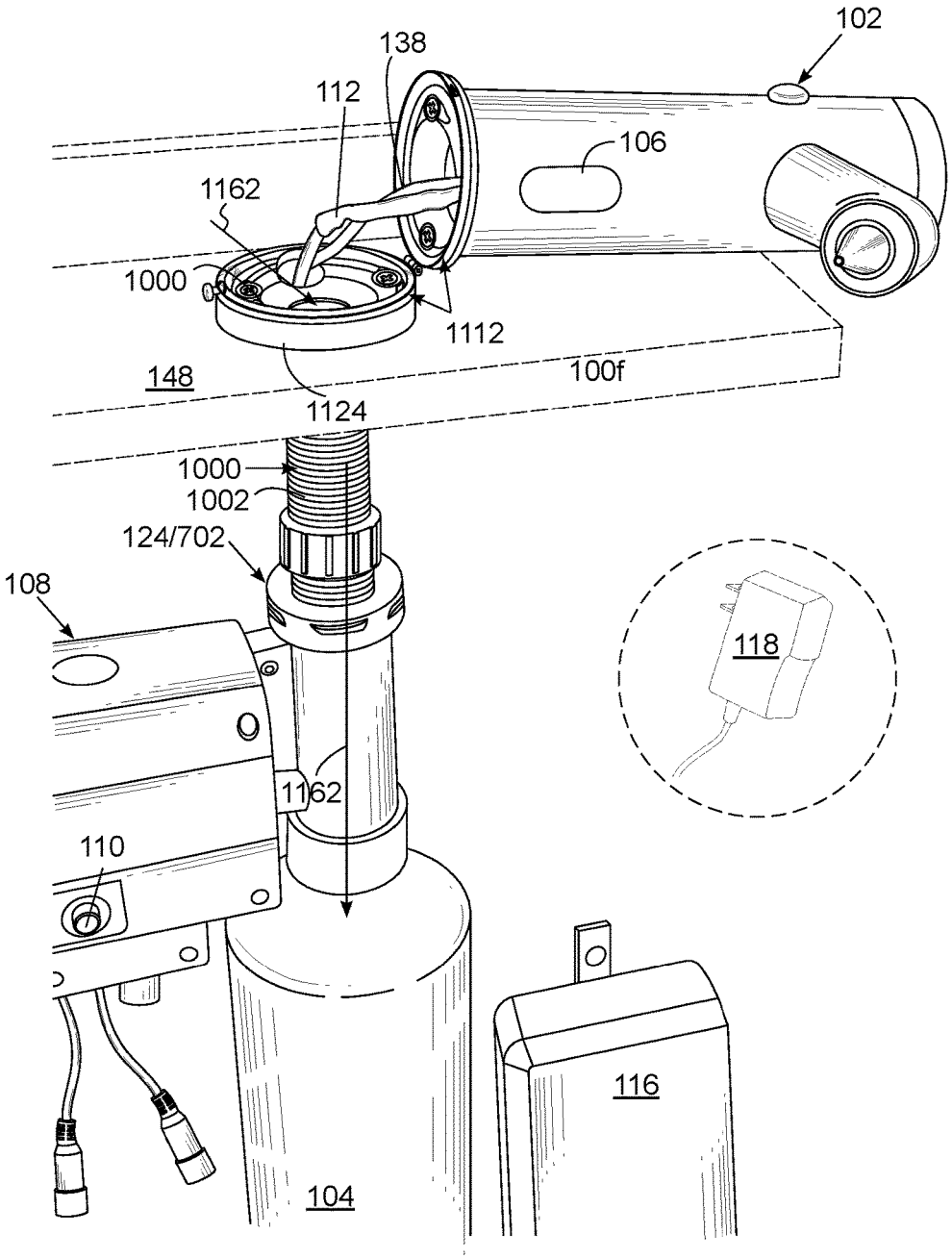
Figure 11C:
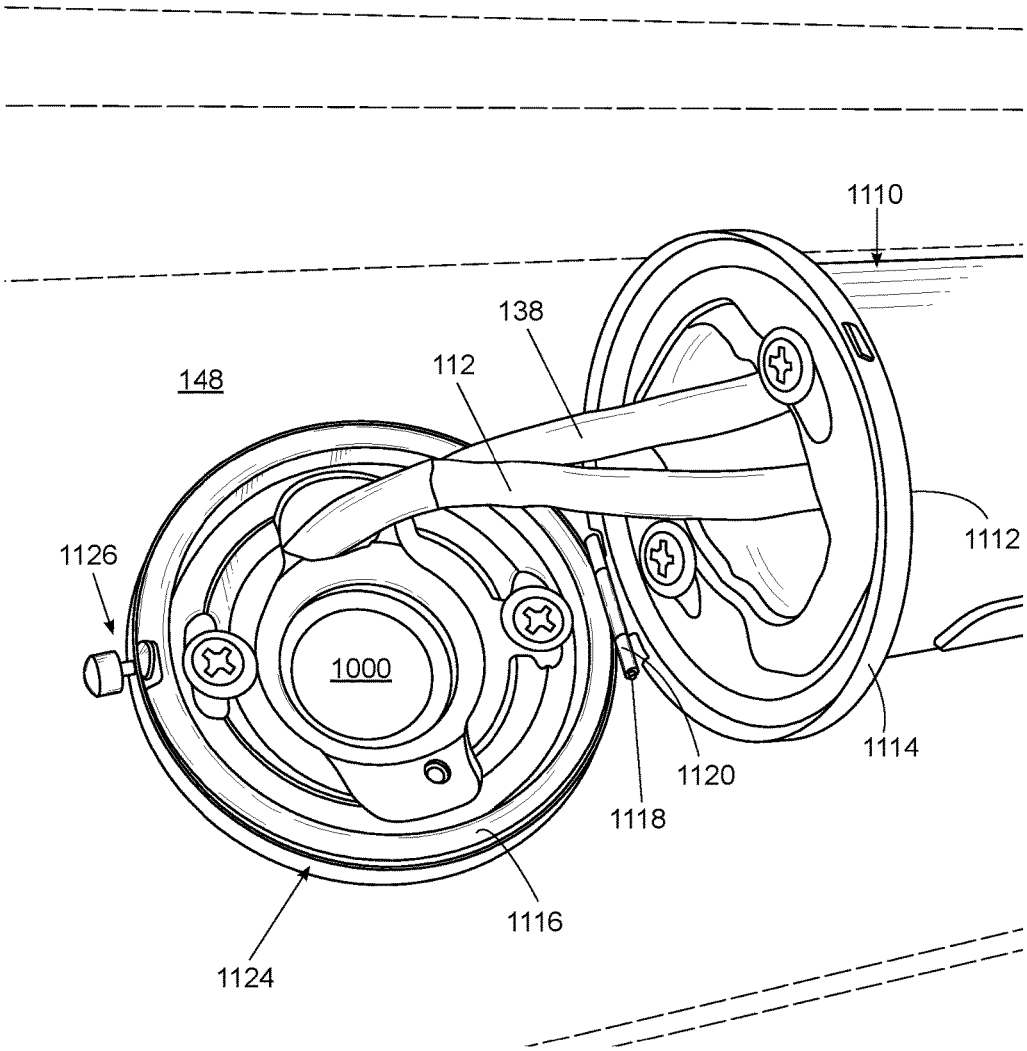
Figures 1, 11D:
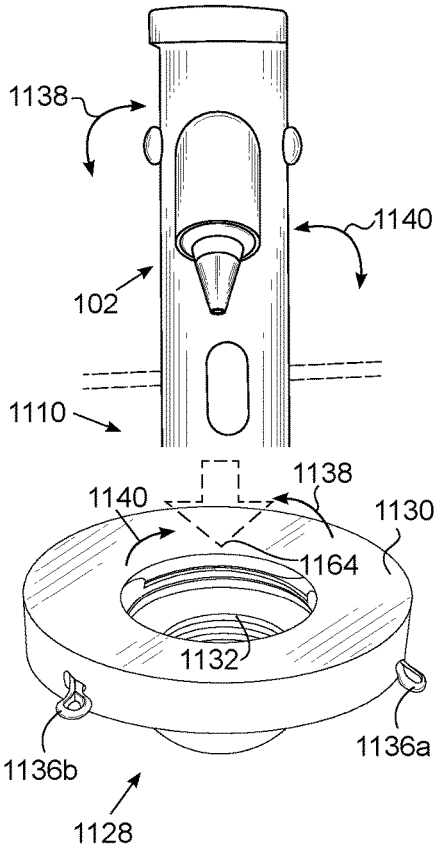
Figures 2, 11D:
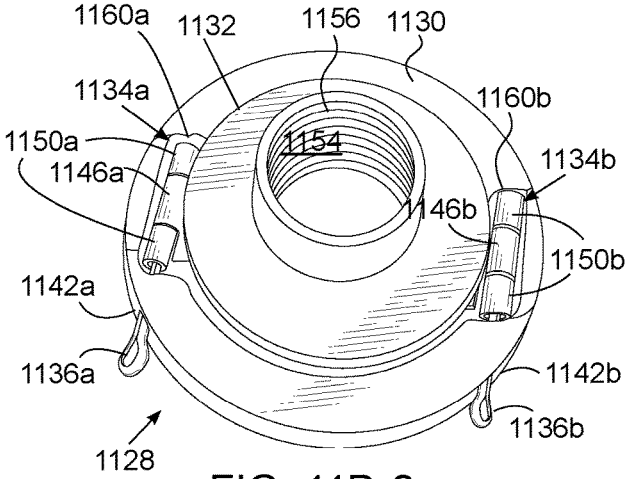
Figures 3, 11D:
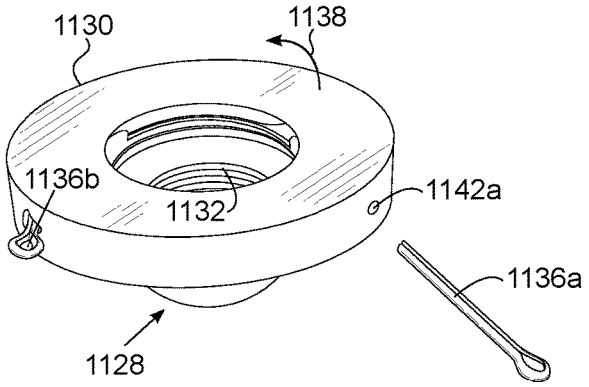
Figures 4, 11D:
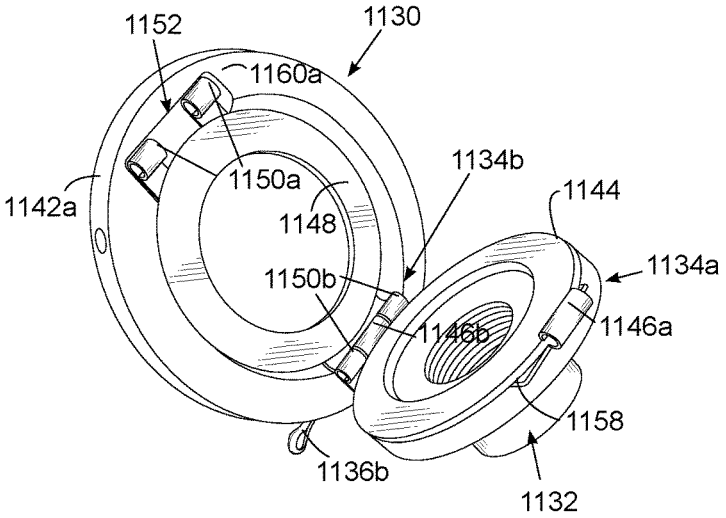
Figures 5, 11D:
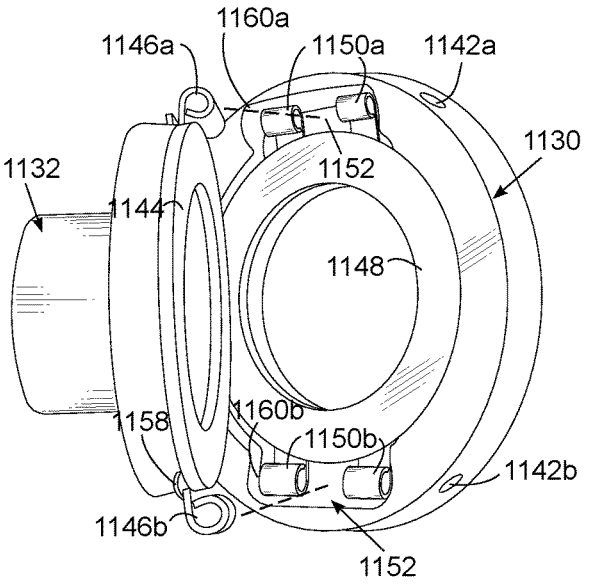

FIGS. 11D-1 to 11D-7 are non-limiting, exemplary illustrations of various views of an embodiment of a countertop adapter in accordance with one or more embodiments. As illustrated, instead of using countertop adapter 1124 that accommodates a single hinge mechanism 1112 to tilt 1108 flow-out member 102 to a single direction, the illustrated countertop adapter 1128 in FIG. 11D-1 to 11D-7 may be used to allow tilting 1108 of flow-out member 102 in opposite directions 1138 and 1140.

Countertop adapter 1128 (used in the orientation illustrated in FIG. 11D-1) includes a first (or top) member 1130, a second (or bottom) member 1132, with first and second members 1130 and 1132 detachably joined by first and second hinge mechanisms 1134*a* and 1134*b*. First member 1130 is comprised of a first hollow disc that accommodates lower end 1110 of flow-out member 102 (insertion orientation shown by arrow 1164) at outer side. First member 1130 may be coupled with lower end 1110 of flow out member 102 in a well known method such as use of fasteners. Second member 1132 includes an internally threaded 1156, hollow cylinder 1154 (FIG. 11D-2) protruded from outer side thereof, which accommodates a top distal end 1042 of countertop fill port 1000.

First member 1130 includes a first internal compartment 1152 that houses a first leaf-barrel combination 1148/1150*a/b* of first and second hinge mechanism 1134*a/b*. Second member 1132 includes a second internal compartment (grooves or notches) 1158 that house or secure in place a second leaf-barrel combination 1144/1146*a/b* of first and second hinge mechanism 1134*a/b*. It should be noted that first member 1130 has a larger diameter than second member 1132.

First leaf-barrel combination 1148/1150*a/b* is comprised of a first O-ring leaf 1148 and first and second set of barrels 1150*a* and 1150*b* that are placed at diametrically opposed positions of first O-ring leaf 1148. Second leaf-barrel combination 1144/1146*a/b* is comprised of a second O-ring leaf 1144 and first and second barrels 1146*a* and 1146*b* that are placed at diametrically opposed positions of second O-ring leaf 1144.

First and second barrels 1146*a/b* of second O-ring leaf 1144 are positioned in between respective first and second set of barrels 1150*a/b* of first O-ring leaf 1148 and are detachably coupled to form first and second hinge mechanism 1134*a/b* by first and second removable pins 1136*a/b*. First member 1130 includes first and second lateral through-holes 1142*a/b*, axially aligned with first and second sets of barrels 1150*a/b* of first O-ring leaf 1148 for receiving and securing removable pins 1136*a/b*, with distal end of pins 1136*a/b* inserted into respective axially aligned blind-holes 1160*a/b*.

Figures 3, 3B:
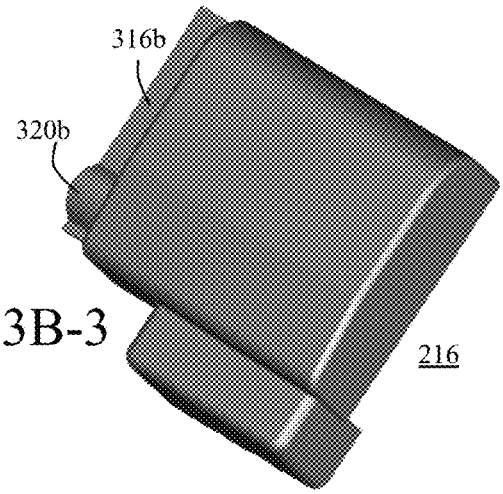

When fully assembled, removing pin 1136*a* (as illustrated in FIG. 11D-3), would allow first member 1130 to move along path 1138, hinged at second hinge mechanism 1134*b* and hence, move coupled flow-out member 102 along path 1138 (as shown in FIG. 11D-1). Alternatively, a user may remove pin 1136*b* that would allow first member 1130 to move along path 1140, hinged at first hinge mechanism

1134*a* and hence, move coupled flow-out member 102 along path 1140 (as shown in FIG. 11D-1). Accordingly, using countertop adapter 1128 in accordance with one or more embodiments of the present invention enables flow-out member 102 to be tilted in diametrically opposed direction. For example, if left of flow-out member 102 is crowded and there is no room for tilting flow-out member 102 to left, countertop adapter 1128 would enable user to instead tilt flow-out member 102 to right or vice versa. It should be noted that the hinge mechanism 1134*a/b* may be replaced by a well known double acting hinge, with hinge leafs appropriately associated with first and second member 1130 and 1132 to allow the members to move in directions illustrated.

Figure 12A:
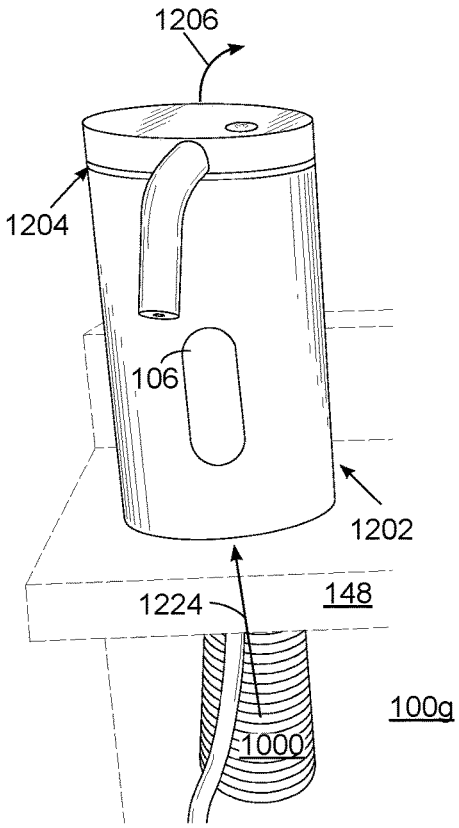
FIGS. 12A to 12B are non-limiting, exemplary illustrations of a fluid dispensing system using a flow-out member with a spout that opens and functions as fill-port in accordance with one or more embodiments of the present invention.
Figure 12B:
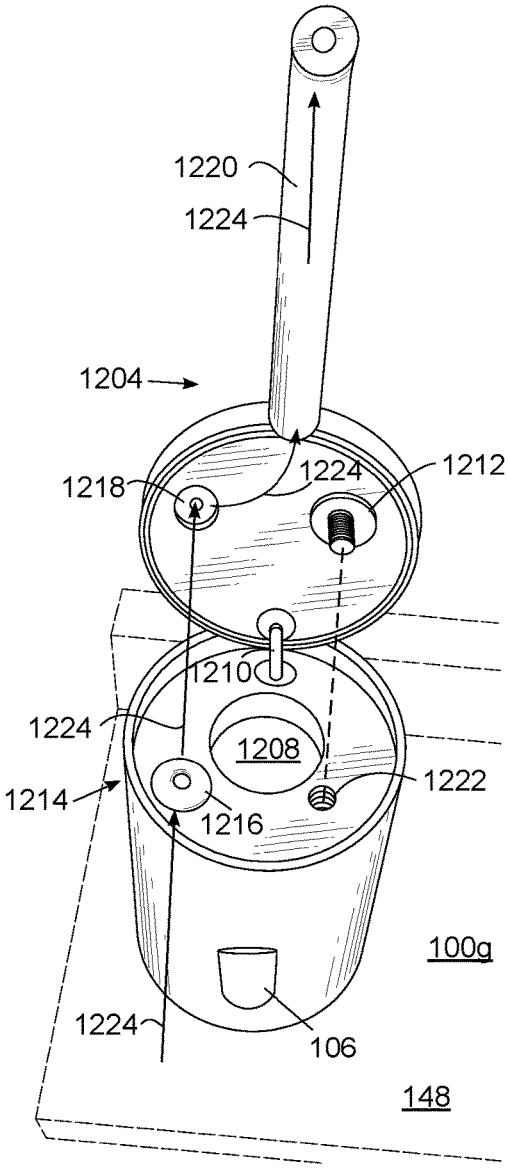

FIGS. 12A to 12B are non-limiting, exemplary illustrations of a fluid dispensing system using a flow-out member with spout that opens access to fill-port in accordance with one or more embodiments of the present invention. The fluid dispensing system 100*g* illustrated in FIGS. 12A to 12B includes similar corresponding or equivalent components, interconnections, functional, operational, and or cooperative relationships as fluid dispensing system 100*a*, 100*b*, 100*c*, 100*d*, 100*e*, and 100*f* that is shown in FIGS. 1A to 11D-5, and described above. Therefore, for the sake of brevity, clarity, convenience, and to avoid duplication, the general description of FIGS. 12A to 12B will not repeat every corresponding or equivalent component, interconnections, functional, operational, and or cooperative relationships that has already been described above in relation to fluid dispensing system 100*a*, 100*b*, 100*c*, 100*d*, 100*e*, and 100*f* that is shown in FIGS. 1A to 11D-5H. As illustrated in FIGS. 12A and 12B, in this non-limiting, exemplary embodiment of the present invention, instead of moving the entire flow-out member 102 moving, the present invention provides a flow-out member 1202 with a nozzle/cap 1204 moves along path 1206 to open access to countertop fill port 1000. Flow-out member 1202 includes a hollow, cylindrical chamber 1208 with internally (female) threaded tubing, a lower end of which couples with distal end 1042 of extender 1002 for eventual access to reservoir 104 for refill. Accordingly, to refill reservoir 104, nozzle/cap 1204 is first opened and next, fluid is poured through hollow, cylindrical chamber 1208, which travels through and finally reaches into reservoir 104.

Moveable nozzle/cap 1204 is coupled with rest of flow-out member 1202 by a hinge 1210, and may be secured thereto by fastener 1212, which engages a corresponding fastener hole 1222. Flow (indicated by arrows 1224) of fluid from reservoir 104 to flow-out member 1202 is similar with other embodiments with the exception that once fluid reaches top distal end 1214 of flow-out member 1202 (via hosing or tubing illustrated in previous embodiments), fluid moves out of an outlet 1216 (which functions as a seal) and into an inlet hole (or cavity) 1218 of moveable nozzle/cap 1204, where fluid is directed to flow out of nozzle 1220. Benefit of flow-out member 1202 with moving nozzle/cap 1204 is that the entire flow-out member (which has a larger, bulker mass than just the spout) need not be moved, which may be more suitable for compact area with less space for maneuverability.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, location and positioning of the inlet port 416 and outlet port 412 of port structure 407 of adapter-conduit 124/702 may be varied. Any suitable types of couplers for the bottom (in relation to the reservoir), the top (in relation to the mounting-support), and mounting portion (in relation to the housing of the fluid displacement mechanism) may be used for adapter-conduit 124/702. As another example, if the fluid displacement mechanism and or the reservoir are remotely located, the mounting-support and the adapter-conduit 124/702 may be eliminated. As yet another example, housing 108 might be smaller or larger; might not contain flush out switch 110 (specially when used with top fill systems). Switch 110 might be mounted to the side of 108 and the battery compartment might be integral to housing 108. flow-out member 102 might be wall mounted (like a wall mounted faucets, for example). Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A fluid dispensing system, comprising:

a flow-out member from which fluid is dispensed;

a regulator; and a fluid displacement mechanism controlled by the regulator;

wherein the fluid displaced, follows a nonlinear path from a reservoir to the flow-out member;

a mounting-support having a first end associated with the flow-out member, and a second end supporting a mounted reservoir, nonlinearly positioning the reservoir in relation to the flow-out member at length commensurate with a longitudinal axis of the mounting-support, and at a desired angle;

the first end of the mounting-support is comprised of:

a first hole; and a second set of holes positioned around the first hole to secure the first end to the flow-out member at a desired orientation to thereby orient and position the second end of the mounting-support nonlinearly at a desired angle in relation to a structure.

2. The fluid dispensing system as set forth in claim 1, wherein:

the regulator is comprised of a detector that senses an object within a detection zone, and further, includes a controller that is in communication with the detector for processing sensed signals from the detector for control of the fluid displacement mechanism.

3. The fluid dispensing system as set forth in claim 1, wherein:

the detector is positioned within the flow-out member.

4. The fluid dispensing system as set forth in claim 1, wherein:

the regulator is positioned within the flow-out member.

5. The fluid dispensing system as set forth in claim 1, wherein:

the fluid displacement mechanism is remotely located.

6. The fluid dispensing system as set forth in claim 1, wherein:

the reservoir is remotely located.

7. The fluid dispensing system as set forth in claim 1, wherein:

the fluid displacement mechanism is comprised of a drive mechanism and a pump, with the drive mechanism actuating the pump for displacement of fluid.

8. The fluid dispensing system as set forth in claim 7, wherein:

the drive mechanism actuates the pump for a first duration to displace fluid in a first direction, and actuates the pump for a second duration to displace fluid in a second direction, opposite the first direction.

9. The fluid dispensing system as set forth in claim 7, wherein:

fluid flowing through the fluid displacement mechanism is isolated from the drive mechanism and internal components of the pump.

10. The fluid dispensing system as set forth in claim 7, wherein:

the pumping is a peristaltic pump.

11. The fluid dispensing system as set forth in claim 1, wherein:

one or more flow-out members are associated with a single, remotely located reservoir.

12. The fluid dispensing system as set forth in claim 7, wherein:

the fluid displacement mechanism further includes a flush switch to flush out and bleed-out air.

13. The fluid dispensing system as set forth in claim 1, wherein:

the second end of the mounting-support is comprised of:

an opening for mounting the reservoir; and a removable barrier that interlocks with the opening to secure the mounting reservoir.

14. The fluid dispensing system as set forth in claim 1, wherein:

the mounted reservoir on the second end of the mounting support is mounted by an adapter-conduit.

15. The fluid dispensing system as set forth in claim 14, wherein:

the adapter-conduit couples a housing of the fluid displacement mechanism with the reservoir.

16. The fluid dispensing system as set forth in claim 14, wherein:

the adapter-conduit is comprised of:

a top opening with a top periphery for coupling with the second end of the mounting-support;

a bottom opening with bottom periphery for coupling with the reservoir;

a mounting portion protruded from a side for coupling with the housing of the fluid displacement mechanism;

a port structure having:

an inlet port associated with the outlet port of the reservoir; and an outlet port associated with the inlet port of the pump.

17. The fluid dispensing system as set forth in claim 16, wherein:

the top opening with the top periphery including an internal coupler for coupling with an extender to allow for a countertop fill port to refill the reservoir from the top.

18. The fluid dispensing system as set forth in claim 17, wherein:

a top of the extender has a lockable lid.

19. The fluid dispensing system as set forth in claim 18, wherein:

the lockable lid is comprised of:

a latch member that maintains the lid in locked position with a retainer member, and is unlocked using a key.

20. The fluid dispensing system as set forth in claim 1, further comprising:

a mounting-support having a first end associated with a structure, and a second end supporting a mounted reservoir, positioning the reservoir in relation to the flow-out member at a desired location.

21. The fluid dispensing system as set forth in claim 1, further, comprising:

a power source that is an Alternating Current (AC), and includes an auxiliary power source in a form of a set of batteries.

22. The fluid dispensing system as set forth in claim 1, wherein:

the flow-out member moves to provide access to a fill-port.

23. The fluid dispensing system as set forth in claim 1, wherein:

a nozzle of a flow-out member moves to provide access to a fill port.

24. The fluid dispensing system as set forth in claim 23, wherein:

Flow of fluid from reservoir to flow-out member moves out of an outlet and into an inlet hole of moveable nozzle, where fluid is directed to flow out of nozzle.

25. The fluid dispensing system as set forth in claim 1, wherein:

the regulator includes a controller that controls flow of fluid in one of a first and second directions for a duration without the use of a flush switch.

26. The fluid dispensing system as set forth in claim 1, further comprising:

tubes that are removable for maintenance.

* * * * *